US010535917B1

(12) United States Patent
Lalezari et al.

(10) Patent No.: US 10,535,917 B1
(45) Date of Patent: Jan. 14, 2020

(54) ANTENNA STRUCTURE FOR USE WITH A HORIZONTALLY POLARIZED SIGNAL

(71) Applicant: FIRST RF Corporation, Boulder, CO (US)

(72) Inventors: Farzin Lalezari, Boulder, CO (US); Michael R. Goulder, Longmont, CO (US)

(73) Assignee: FIRST RF Corporation, Boulder, CO (US)

( * ) Notice: Subject to any disclaimer, the term of this patent is extended or adjusted under 35 U.S.C. 154(b) by 0 days.

(21) Appl. No.: 15/970,528

(22) Filed: May 3, 2018

(51) Int. Cl.

| | |
|---|---|
| ***H01Q 1/28*** | (2006.01) |
| ***H01Q 1/48*** | (2006.01) |
| ***H01Q 9/04*** | (2006.01) |
| ***H01Q 3/34*** | (2006.01) |
| ***H01Q 21/06*** | (2006.01) |
| ***H01Q 1/42*** | (2006.01) |
| ***H01Q 1/52*** | (2006.01) |
| *H01Q 1/30* | (2006.01) |
| *H01Q 9/16* | (2006.01) |
| *H01Q 9/18* | (2006.01) |
| *H01Q 9/20* | (2006.01) |
| *H01Q 9/06* | (2006.01) |

(52) U.S. Cl.
CPC ..... *H01Q 1/28* (2013.01); *H01Q 1/42* (2013.01); *H01Q 1/48* (2013.01); *H01Q 1/523* (2013.01); *H01Q 3/34* (2013.01); *H01Q 9/0421* (2013.01); *H01Q 21/065* (2013.01); *H01Q 21/067* (2013.01); *H01Q 1/281* (2013.01); *H01Q 1/282* (2013.01); *H01Q 1/285* (2013.01); *H01Q 1/286* (2013.01); *H01Q 1/287* (2013.01); *H01Q 1/30* (2013.01); *H01Q 9/065* (2013.01); *H01Q 9/16* (2013.01); *H01Q 9/18* (2013.01); *H01Q 9/20* (2013.01)

(58) Field of Classification Search
CPC ..... H01Q 1/28; H01Q 1/281; H01Q 1/282; H01Q 1/283; H01Q 1/285; H01Q 1/286; H01Q 1/287; H01Q 1/30; H01Q 9/16; H01Q 9/18; H01Q 9/20; H01Q 9/285; H01Q 9/065
See application file for complete search history.

(56) References Cited

U.S. PATENT DOCUMENTS

| | | | | |
|---|---|---|---|---|
| 5,283,590 | A * | 2/1994 | Wong | H01Q 3/44 343/754 |
| 6,249,260 | B1 | 6/2001 | Holloway | |
| 2011/0057852 | A1 * | 3/2011 | Holland | H01Q 9/28 343/795 |

* cited by examiner

*Primary Examiner* — Binh B Tran
(74) *Attorney, Agent, or Firm* — Lathrop Gage LLP

(57) ABSTRACT

The invention is directed to an antenna structure for producing a horizontally polarized beam. In one embodiment, the antenna structure includes a first quarter-wave patch antenna and a second quarter-wave patch antenna that are positioned such that the ground planes of the patch antennas or a ground plane shared by the patch antennas is disposed between the patches of the two antennas and the shorting structures associated with the antennas are substantially aligned. In operation, the antenna structure is capable of processing an omni-directional, horizontally polarized beam.

34 Claims, 17 Drawing Sheets

Fig. 4G
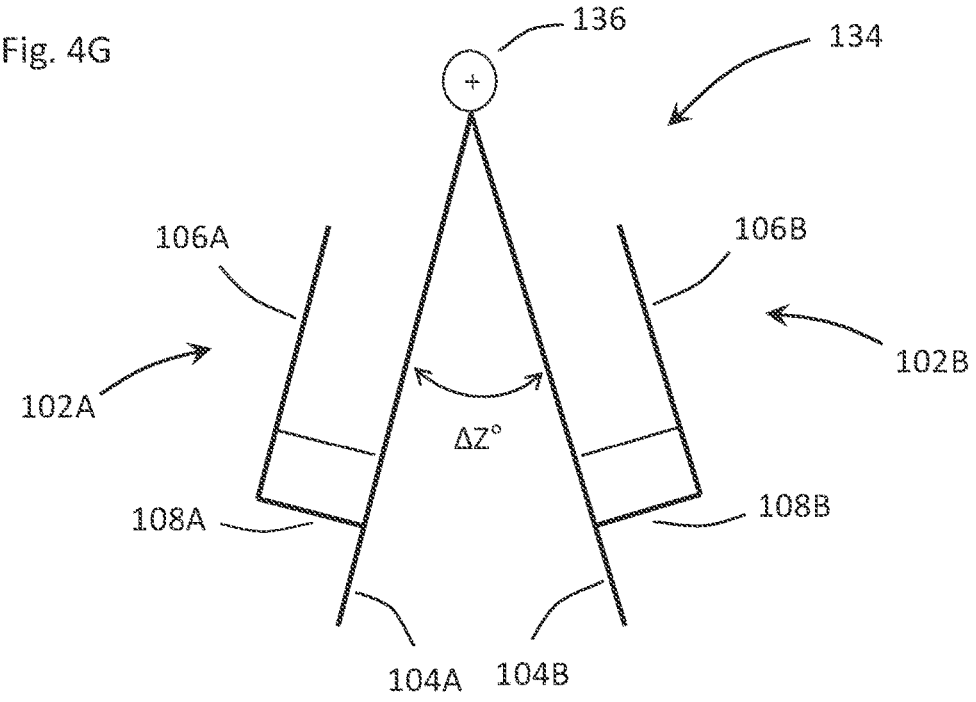
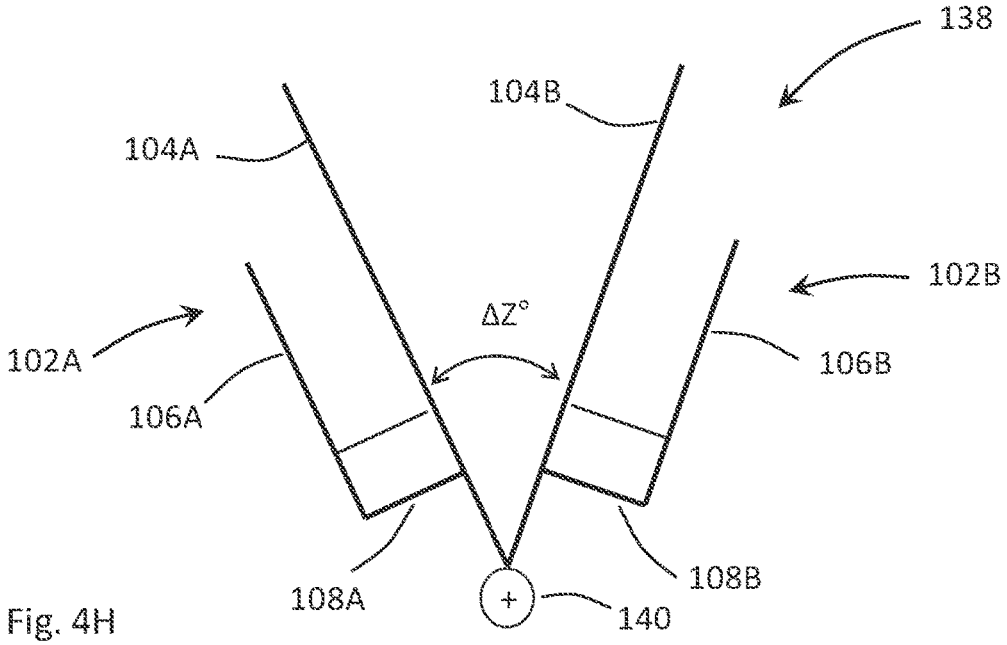
Fig. 4H

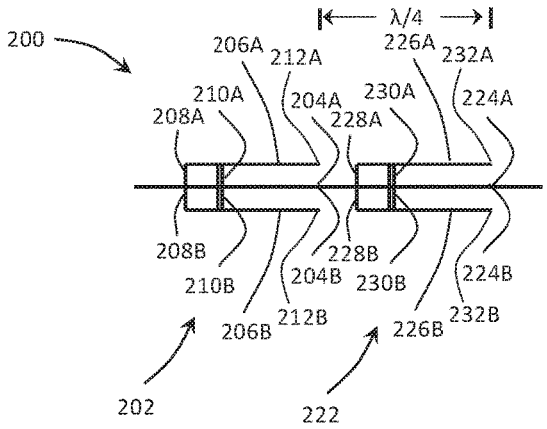
Fig. 5A
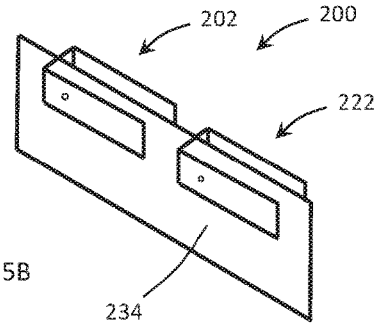
Fig. 5B
Fig. 5C
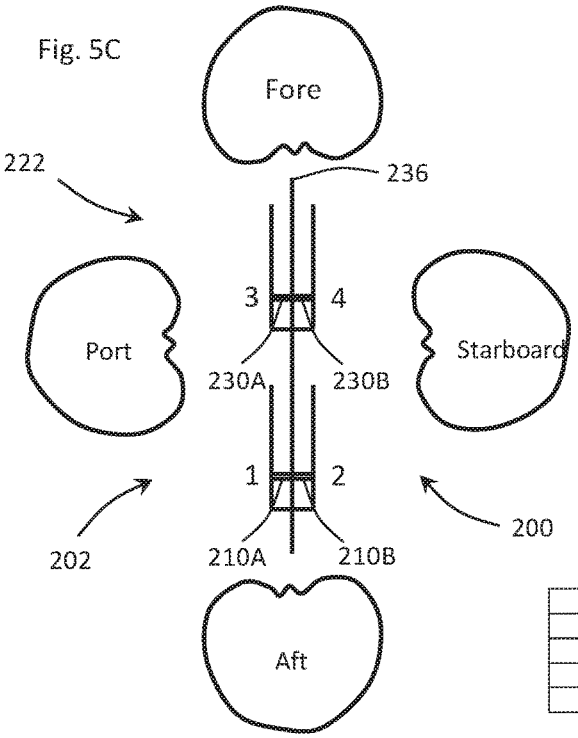
| | Omni | Port | Starboard | Fore | Aft |
|---|---|---|---|---|---|
| 1 | 0 | 0 | Off | 0 | 0 |
| 2 | 180 | Off | 0 | 180 | 180 |
| 3 | Off | 0 | Off | 90 | 270 |
| 4 | Off | Off | 0 | 270 | 90 |
Fig. 5D

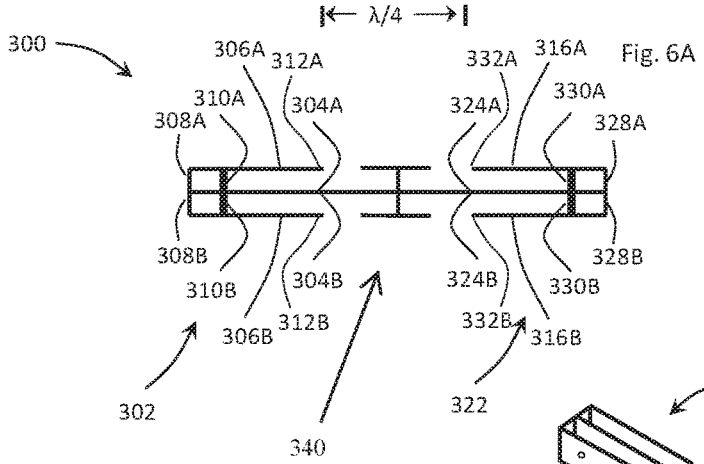
Fig. 6A
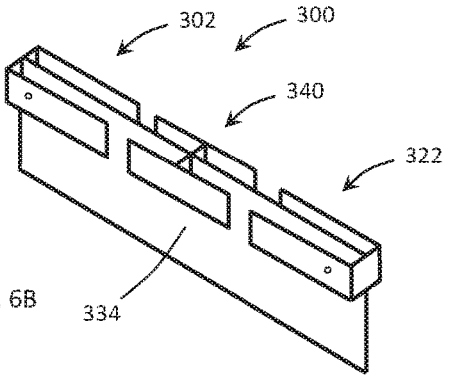
Fig. 6B
Fig. 6C
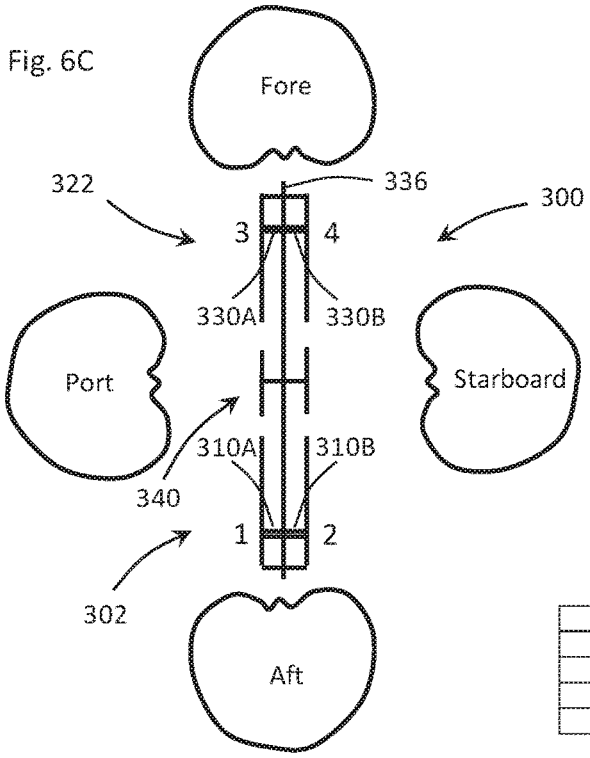
| | Omni | Port | Starboard | Fore | Aft |
|---|---|---|---|---|---|
| 1 | 0 | 0 | Off | 0 | 0 |
| 2 | 180 | Off | 0 | 180 | 180 |
| 3 | Off | 180 | Off | 270 | 90 |
| 4 | Off | Off | 180 | 90 | 270 |
Fig. 6D

| | Beam 1 | Beam 2 | Beam 3 | Beam 4 |
|---|---|---|---|---|
| 1 | 76 | -289 | 104 | -13 |
| 2 | 224 | 175 | 256 | -52 |
| 3 | 0 | 152 | -223 | 65 |
| 4 | -152 | 52 | -89 | -274 |

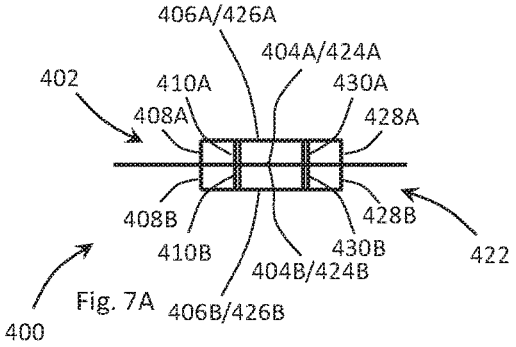
Fig. 7A
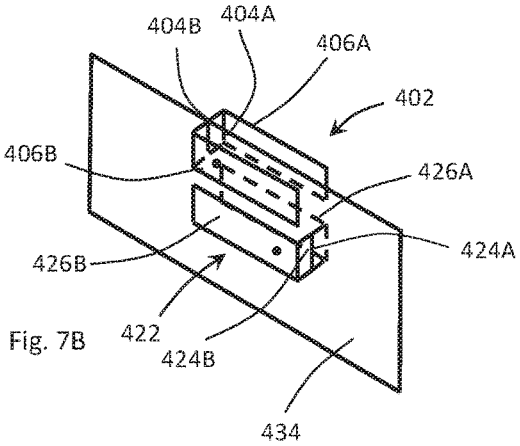
Fig. 7B
Fig. 7C
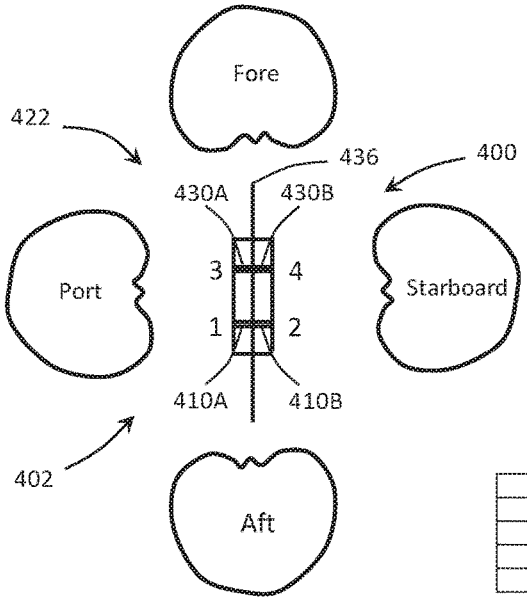
| | Omni | Port | Starboard | Fore | Aft |
|---|---|---|---|---|---|
| 1 | 0 | 0 | Off | 0 | 0 |
| 2 | 180 | Off | 0 | 180 | 180 |
| 3 | Off | 180 | Off | 90 | 270 |
| 4 | Off | Off | 180 | 270 | 90 |
Fig. 7D

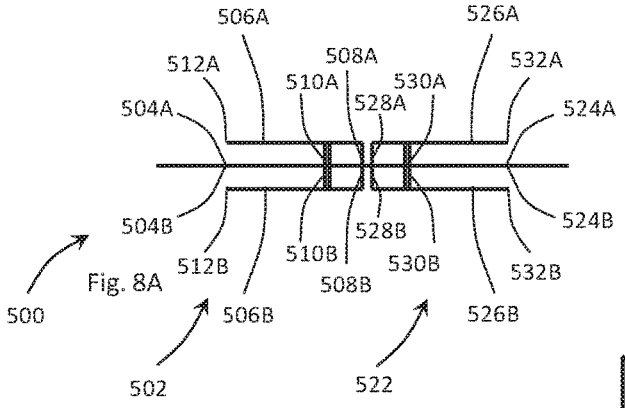
Fig. 8A
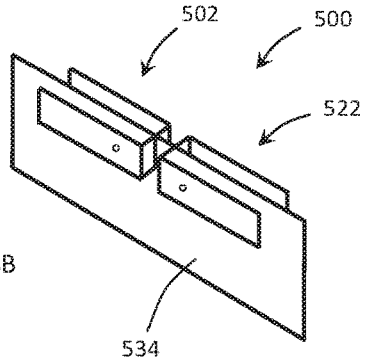
Fig. 8B
Fig. 8C
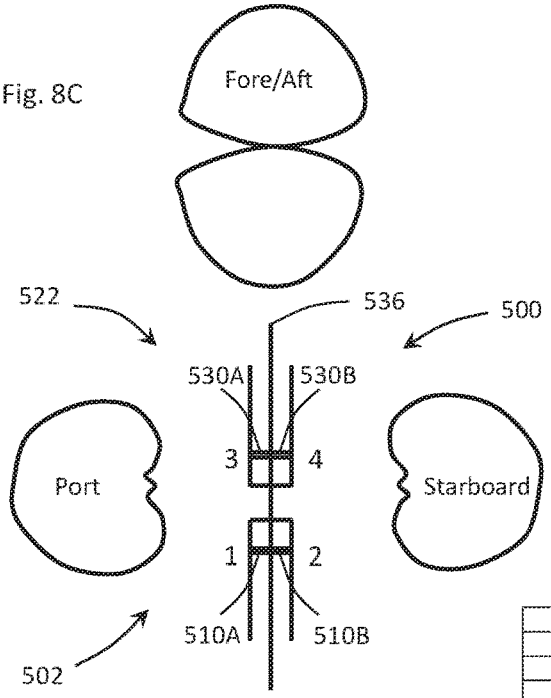
| | Omni | Port | Starboard | | Fore/Aft |
|---|---|---|---|---|---|
| 1 | 0 | 0 | Off | | 0 |
| 2 | 180 | Off | 0 | | 180 |
| 3 | Off | 180 | Off | | 0 |
| 4 | Off | Off | 180 | | 180 |
Fig. 8D 624
600
630
610
602
628
632

626
600
610
628
630
602
10C
600
628
630
632
10C 10A
10B
600
628
602
10A
10B

Fig. 10A
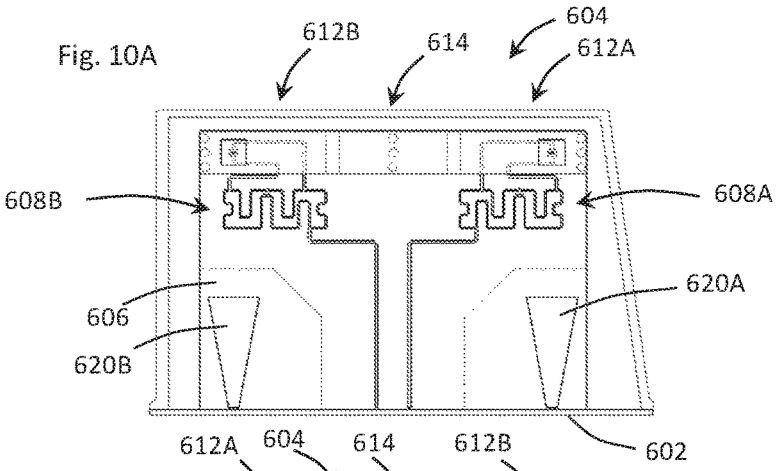
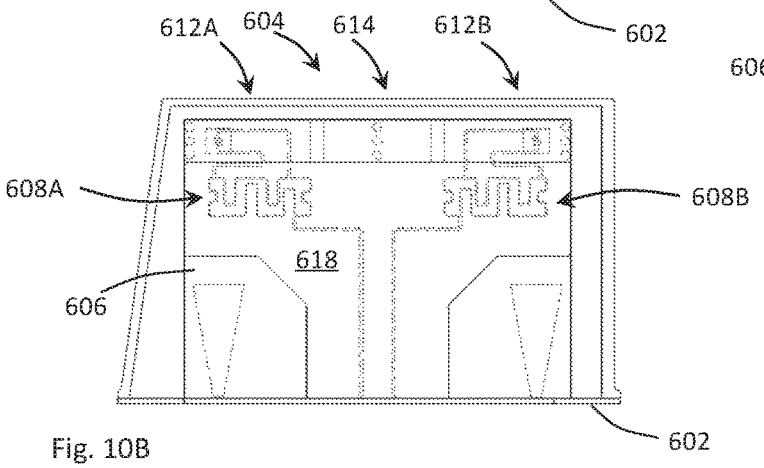
Fig. 10B
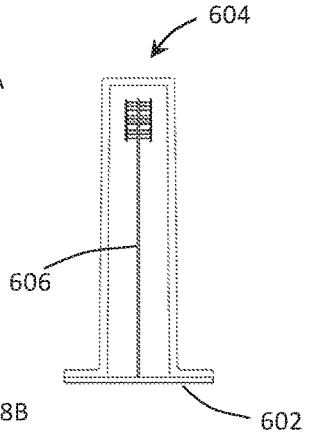
Fig. 10C

ANTENNA STRUCTURE FOR USE WITH A HORIZONTALLY POLARIZED SIGNAL

FIELD OF THE INVENTION

The invention relates to antennas and, more specifically, to an antenna structure adapted to provide a horizontally polarized beam.

BACKGROUND OF THE INVENTION

Presently, antenna structures for generating an omnidirectional, horizontally polarized beam are used in a number of applications, including on aircraft where the antenna structures are mounted either on the top or bottom surfaces of the fuselage. In such applications, the antenna structure generally includes: (a) a planar radiator structure, (b) a feed structure for conveying a signal between the radiator structure and an interface associated with the aircraft, the feed structure having a length that allows the radiator structure to be positioned a desired distance away from the exterior surface of the aircraft, and (c) a support structure that serves to support the radiator structure at a desired distance away from the exterior of the aircraft. More specifically, when the aircraft is positioned such that the roll and pitch axes of the aircraft are parallel to a flat surface, the support structure serves to position the planar radiator structure in a plane that is parallel to the flat surface or the plane defined by the roll and pitches axes, and at a specified distance from the exterior surface of the aircraft. Since the antenna structure extends away from the exterior surface of the aircraft, the antenna structure impacts the aerodynamics of the aircraft with which the antenna structure is associated. To address aerodynamic concerns, the antenna structure includes an aerodynamic radome, which may be all or a part of the support structure. Typically, the width of the radiator structure (as measured along in the pitch axis direction) is at least $\lambda_L/2$, where $\lambda_L$ is the wavelength associated with the frequency that defines the low end of the bandwidth of the antenna. The support structure commonly has a height of at least $\lambda_L/4$ and a relatively narrow width that is considerably less than $\lambda_L/2$. Given the dimensions of the radiator and support structures, the radome typically has a T-configuration. An example of such an antenna structure can be found in U.S. Pat. No. 6,249,260. Such radomes are costly to manufacture, difficult to build, and can increase aerodynamic drag (thereby increasing the operating expense of the aircraft).

SUMMARY OF THE INVENTION

The present invention is directed to an antenna structure that is adapted to provide a horizontally polarized signal and can be adapted to have a radiator structure with a width that is significantly smaller than the width associated with omnidirectional, horizontally polarized antennas such as the antenna disclosed in U.S. Pat. No. 6,249,260.

In one embodiment, the antenna structure includes two, quarter-wave patch antennas that are positioned "back-to-back" relative to one another. To elaborate, a quarter-wave patch antenna includes a ground plane, a radiator patch that is spaced from the ground plane, a shorting structure that electrically connects the ground plane and the radiator patch, and a feed point for providing a signal to the radiator patch and/or receiving a signal from the radiator patch. The back-to-back positioning of the two, quarter-wave patch antennas results in the ground planes of the two, quarter-wave patch antennas being positioned between the radiator patches of the two antennas. Further, in back-to-back positioning of the two, quarter-wave patch antennas, the antennas are oriented so that, if the shorting structures are considered to form a single structure, the radiator patches both extend away from this structure in substantially the same direction. As such, in an embodiment of the antenna structure in which the radiator patches are parallel to one another, the shorting structures are perpendicular to the radiator patches and aligned with one another, and a monolithic structure that is disposed between the radiator patches provides the ground planes for both antennas, the antenna structure has a trident-like or psi-like (T) shape. It should be appreciated that various differences in the structures of the two, quarter-wave patch antennas and their orientation to one another can be tolerated and the antenna structure utilized to achieve omnidirectional, horizontally polarized signal processing. For instance, the ground planes can be separated from one another thereby resulting in the antennas having a "split," psi-like shape. As another example, the shorting structures may not be colinear/coplanar with one another so that the antennas have a "skewed," psi-like shape. Moreover, it should be appreciated that an antenna structure with back-to-back, quarter-wave patch antennas, when compared to a single, quarter-wave patch antenna, is capable of processing an omnidirectional, horizontally polarized signal that has significantly less ripple and significantly less cross-pol.

An antenna structure with back-to-back, quarter-wave patch antennas can be used to achieve a relatively thin antenna structure that, in particular applications, avoids the need for a T-shaped radome. To elaborate, the distance between the radiator patches of an antenna structure with back-to-back, quarter-wave patch antennas substantially defines the width of the antenna structure. While the width of the antenna structure can be as large as $3\lambda_L/4$ (where $\lambda_L$ is the wavelength associated with the frequency that defines the low end of the bandwidth of the combined antennas), the width can preferably be less than $\lambda_L/2$ and more preferably less than $\lambda_L/5$. When the width of the antenna structure is relatively small and the antenna structure is used in an aircraft application or similar application, the need for a T-shaped radome to house the quarter-wave patch antennas is substantially eliminated and a blade-shaped radome with a more aerodynamic profile can be employed.

In another embodiment, an antenna structure is provided that includes back-to-back, quarter-wave patch antennas with the distance between the ground planes of two antennas being less than $\lambda_L/4$.

An additional embodiment of the antenna structure includes back-to-back, quarter-wave patch antennas and a combiner-divider network for: (a) when the antennas are being used to receive a signal, combining the signals from the two feed points associated with the antennas into a single signal that can be applied to a receiver or transceiver and (b) when the antennas are being used to transmit a signaling, dividing a signal from a transmitter or transceiver into two signals, one for each of the two feed points associated with the antennas. In a preferred embodiment that facilitates processing of an omnidirectional, horizontally polarized beam, the combiner-divider include a phase-shifter that, in operation, imparts a 180° phase shift to the signal associated with the feed point of one of the back-to-back, quarter-wave antennas.

In yet a further embodiment, an antenna structure comprises back-to-back, quarter-wave patch antennas and a stand that is adapted to support the back-to-back, quarter-wave patch antennas at least $\lambda_L/4$ above a surface, such as the fuselage of an aircraft. The stand extends from a first terminal end to a second terminal end. The first terminal end is adapted to engage a structure, such as the fuselage of an aircraft. At a location spaced from the first terminal end, the stand is adapted to support the back-to-back, quarter-wave antennas at the required distance from the first terminal end. In a particular embodiment, this location is at the second terminal end of the stand.

What has previously been described as two, quarter-wave patch antennas or back-to-back, quarter-wave patch antennas will, for convenience, frequently be referred to hereinafter as an antenna pair or pair of antennas. It has been found that an antenna structure having two of these antenna pairs can be used to process horizontally polarized signal having a selected one of: (a) an omnidirectional, beam pattern, (b) forward end-fire beam pattern, (c) an aftward end-fire beam pattern, (d) a port side beam pattern, and (e) a starboard side beam pattern by appropriate control of each of the four feed points in such an antenna structure. As such, when the antenna structure is mounted to an aircraft and the axis of the antenna structure is substantially parallel to the roll axis of the aircraft, a forward beam extends from the antenna structure towards the nose of the aircraft; an aftward beam extends from the antenna structure towards the tail of the aircraft; a port side beam extends from the antenna structure towards the port side wing; and a starboard side beam extends from the antenna structure towards the starboard side wing. In many embodiments in which a monolithic structure supplies all of the grounds, the axis of the antenna is a line that is in the plane of the monolithic structure and intersects two lines, one line connecting the feed points associated with one back-to-back antenna pair and the other line connecting the feed points associated with the other back-to-back antenna pair. The control associated with each of the feed points involves being able to turn "on" (i.e., connect) or "off" (i.e., disconnect) the feed point and, with respect to a feed point that is turned "on," apply one of two phase shifts to whatever signal the feed point is carrying. It should be appreciated that one of these two phase shifts could be a 0° phase shift. Further, by appropriately limiting the control (on/off and phase shift) that can be applied to the feed points, the number of beam patterns that can be selected can be reduced. For instance, by turning "on" each of the four feed points and applying a single, specific phase shift to the signals associated each of the four feed points, the antenna structure could be limited to processing, for example, only a forward end-fire beam pattern. The following describes three antennas structures that each include two pairs of antennas and can be used to generate any of the five above-noted beam patterns. Also described is an antenna structure that can be used to generate three of the five above-noted beam patterns and a composite forward-aftward beam pattern.

One embodiment of an antenna structure that includes two pairs of antennas has the shorting structures of one of the two pairs of antennas located between the radiator patches of the two pairs of antennas, the radiator patches of the other of the two pairs of antennas located between shorting structures of the first and second pairs of antennas, the ground planes of the two pairs of antennas substantially aligned, and the radiator patches of the two pairs of antennas substantially aligned with one another. It should be appreciated that various differences in the structures associated with each of the quarter-wave patch antennas in a pair of antennas, the orientation of the quarter-wave patch antennas forming a pair of antennas, and the orientation of the two pairs of antennas to one another can be tolerated and horizontally polarized signal operation with any one of the five possible patterns still achieved.

Another embodiment of an antenna structure that includes two pairs of antennas employs an isolator structure. In a particular embodiment, the isolator structure is positioned between the two pairs of antennas, the radiator patches of the two pairs of antennas are positioned between the shorting structures of the two pairs of antennas, the ground planes of the two pairs of antennas are substantially aligned, and the radiator patches of the first of the two pairs of antennas are substantially aligned with the radiator patches of the second of the two pairs of antennas. In this embodiment, the isolator structure has an "I" shape with each of the cross-bars at the top and bottom of "I" being substantially aligned with one of the radiator patches associated with each of the two pairs of antennas. It should be appreciated that various differences in the structures associated with each of the quarter-wave patch antennas in a pair of antennas, the orientation of the quarter-wave patch antennas forming a pair of antennas, and the orientation of the two pairs of antennas to one another can be tolerated and horizontally polarized signal operation with any one of the five possible beam patterns still achieved.

Another embodiment of such an antenna structure that includes two pairs of antennas "stacks" the two pairs of antennas. In a particular embodiment, the ground planes of the two pairs of antennas are substantially aligned, and the radiator patches of the first of the two pairs of antennas are substantially aligned with the radiator patches of the second of the two pairs of antennas, the shorting structures of each of the pair of antennas is substantially perpendicular to the radiators patches for the pair of antennas, the shorting structure of the first of the two pairs of antennas is coplanar with a plane defined by the end of the radiator patches associated with the second of the two pairs of antennas, and the shorting structure of the second of the two pairs of antennas is coplanar with a plane defined by the end of the radiator patches associated with the first of the two pairs of antennas. If a monolithic structure is disposed between the radiator patches of both pairs of antenna to provide the ground planes for the four quarter-wave patch antennas, the combined structure, when viewed such that one pair of antennas is above the other pair of antennas, has a Φ-like shape. It should be appreciated that various differences in the structures associated with each of the quarter-wave patch antennas in a pair of antennas, the orientation of the quarter-wave patch antennas forming a pair of antennas, and the orientation of the two pairs of antennas to one another can be tolerated and horizontally polarized signal operation with any one of the five possible beam patterns still achieved.

Yet another embodiment of an antenna structure that employs to two pairs of antennas is capable of processing an omnidirectional beam pattern, a port side beam pattern, a starboard side beam pattern, and a "combined" forward-aftward beam pattern by appropriate control of each of the four feed points associated with the antenna structure. In this embodiment, the antenna structure employs two pairs of antennas with the shorting structures of the two pairs of located between the radiator patches of the two pairs of antennas, the ground planes of the two pairs of antennas substantially aligned, and the radiators structures of the two pairs of antennas substantially aligned with one another. It should be appreciated that various differences in the structures associated with each of the quarter-wave antennas in a pair of antennas, the orientation of the quarter-wave antennas forming a pair of antennas, and the orientation of the two, pairs of antennas to one another can be tolerated and horizontally polarized signal operation with any one of the possible modes still achieved.

BRIEF DESCRIPTION OF THE DRAWINGS

FIGS. 4E-4H illustrate rotational variations in the positions of the two, quarter-wave patch antenna shown in FIG. 4A that can be tolerated and omnidirectional, horizontally polarized signal operation achieved;

FIGS. 5A-5D illustrate a first embodiment of an antenna structure that employs two pairs of back-to-back, quarter-wave antenna and can be used to process a horizontally polarized signal having a selected one of: (a) an omnidirectional beam pattern, (b) forward end-fire beam pattern, (c) aftward end-fire beam pattern, (d) port side beam pattern, and (e) starboard side beam pattern;

FIGS. 6A-6D illustrate a second embodiment of an antenna structure that employs two pairs of back-to-back, quarter-wave antenna and can be used to process a horizontally polarized signal having a selected one of: (a) an omnidirectional beam pattern, (b) forward end-fire beam pattern, (c) aftward end-fire beam pattern, (d) port side beam pattern, and (e) starboard side beam pattern;

FIGS. 7A-7D illustrate a third embodiment of an antenna structure that employs two pairs of back-to-back, quarter-wave antenna and can be used to process a horizontally polarized signal having a selected one of: (a) an omnidirectional beam pattern, (b) forward end-fire beam pattern, (c) aftward end-fire beam pattern, (d) port side beam pattern, and (e) starboard side beam pattern;

FIGS. 8A-8D illustrate an embodiment of an antenna structure that employs two pairs of back-to-back, quarter-wave antennas and can be used to process a horizontally polarized signal having a selected one of: (a) an omnidirectional beam pattern, (b) combination forward-aftward beam pattern, (c) port side beam pattern, and (d) starboard side beam pattern;

FIGS. 10A-10C are cross-sectional views of the antenna structure shown in FIGS. 9A-9D.

DETAILED DESCRIPTION

The invention is directed to an antenna structure capable of processing an omnidirectional, horizontally polarized signal. Common to each embodiment of the antenna structure is at least one pair of quarter-wave patch antennas. To facilitate the description of these antenna structures, a single quarter-wave patch antenna is initially described.

Figure 1A:
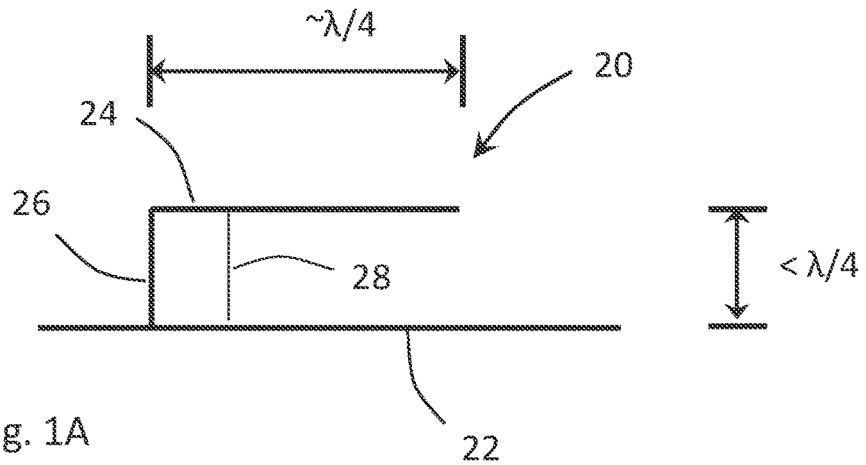
FIG. 1A is a schematic diagram of a quarter-wave patch antenna.
Figure 1B:
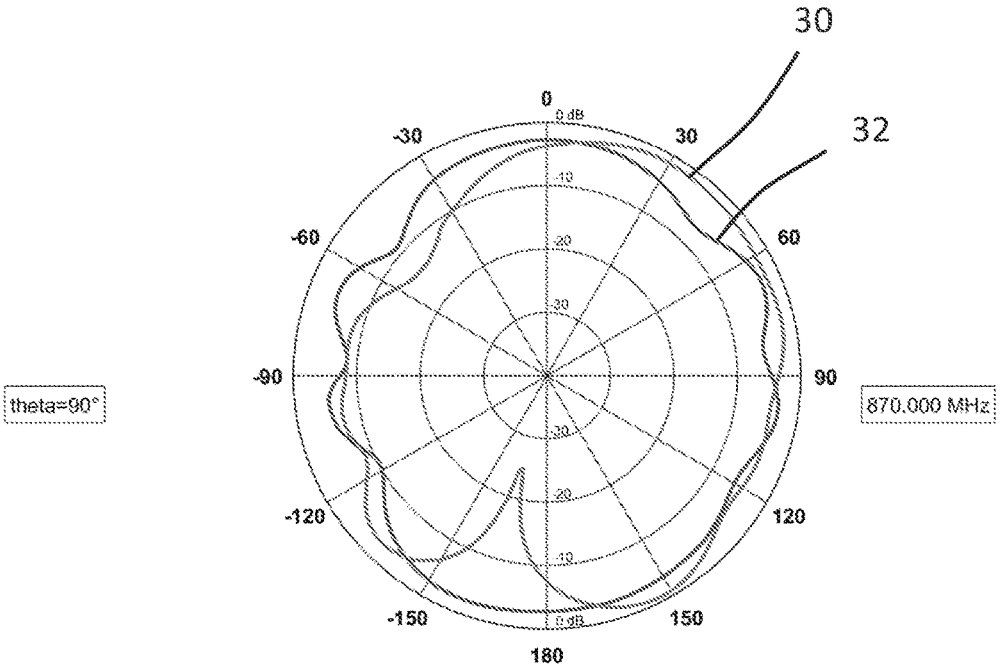
FIG. 1B illustrates the horizontally polarized signal pattern and the cross pol signal pattern processed by a typical quarter-wave patch antenna, such as the antenna shown in FIG. 1.

With reference to FIGS. 1A and 1B, a quarter-wave patch antenna 20 and the operation of such an antenna are described. The quarter-wave patch antenna 20 includes a ground plane 22, a radiator patch 24, a shorting structure 26 for electrically connecting the ground plane 22 and the radiator patch 24, and a feed point 28 that provides the electrical connection for conveying a signal to and/or from the radiator patch 24. Further, the greatest horizontal distance (as measured along the ground plane 22) from a point at which the shorting structure 26 establishes an electrical connection with the ground plane 22 to a point associated with the radiator patch 24 is about $\lambda_L/4$, where $\lambda_L$ is the wavelength associated with the frequency that defines the low end of the bandwidth of the antenna. This horizontal distance is somewhat less than $\lambda_L/4$. To elaborate, the "electrical" length of a quarter wave patch is $\lambda_L/4$. The electrical length is the sum of: (a) the greatest horizontal distance from a location at which the shorting structure establishes an electrical connection with the ground plane to a point on the ground plane that represents the greatest horizontal distance of a point associated with the radiator patch from the location at which the shorting structure establishes the electrical connection to the ground plane and (b) the horizontal distance associated with the fringing fields, which extend beyond the radiating edge of radiator structure. Due to the non-zero but relatively small horizontal distance associated with the fringing fields, the horizontal length from the location at which the shorting structure establishes an electrical connection with the ground plane to a point on the ground plane that represent the most distant point associated with the radiator is less than $\lambda_L/4$ but relatively close to $\lambda_L/4$. In addition, the distance between the ground plane 22 and the radiator patch 24 is less than $\lambda_L/4$. In operation, the antenna 20 is capable of processing (i.e., transmitting and/or receiving) a horizontally polarized signal having a horizontal gain pattern 30. Notably, while the antenna 20 is capable of processing a horizontally polarized signal throughout a 360° azimuth, the horizontal gain pattern 30 has considerable "ripple" throughout the 360° azimuthal extent of the pattern, including a particularly significant "ripple" in the −150° to −180° range. Due to the extent of the "rippling" in the horizontal gain pattern 30, the antenna 20 cannot be characterized as being able to process an omnidirectional, horizontally polarized signal. An antenna that is capable of processing an omnidirectional, horizontally polarized signal is defined herein as having a non-zero gain throughout a 360° azimuth and no more than a 10 dB ripple (i.e., difference between the greatest and least gains in the pattern) in the gain pattern, preferably less than 8 dB ripple, and even more preferably less than 6 dB ripple in the horizontal gain pattern. Also noteworthy is that the antenna 20 simultaneously processes a vertically polarized signal or cross-polarized signal with a vertical polarized gain or cross-pol gain pattern 32 that has comparable power gain to the power gain associated with the horizontally gain pattern 30. As such, while the antenna 20 is capable of processing a horizontally polarized signal, a significant portion of the signal power exhibited by the antenna 20 is devoted to a cross-polarized or vertically polarized signal. An antenna capable of processing horizontally polarized signal is further characterized herein as a signal that has a horizontally polarized gain pattern with related cross-pol or vertically polarized gain pattern that is at least 10 dB less than the horizontal gain throughout the 360° range of the horizontally polarized gain pattern.

Figure 2A:
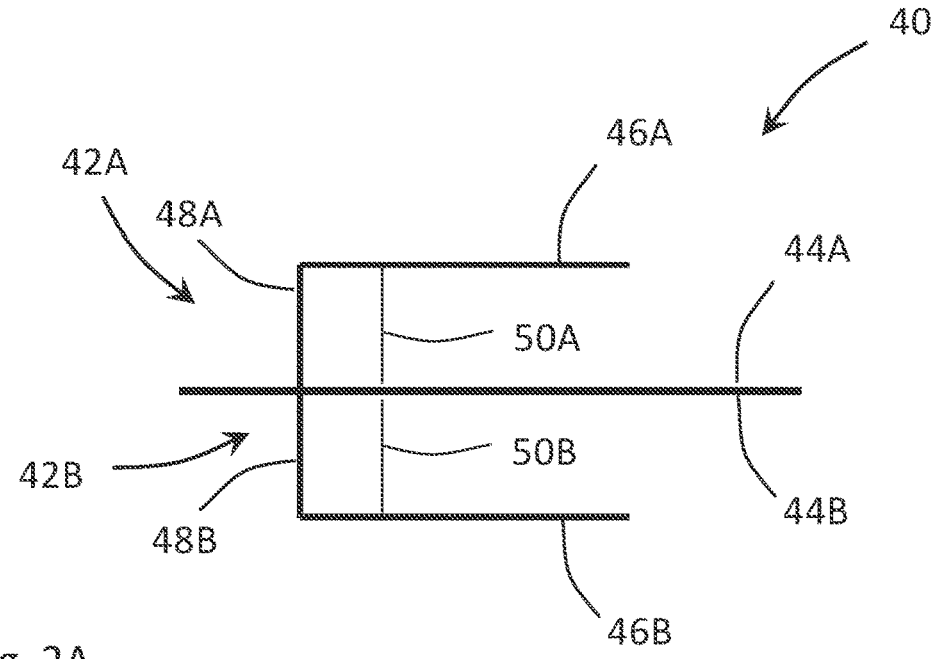
FIG. 2A is a schematic diagram of a first embodiment of an antenna structure that employs a pair of quarter-wave patch antennas and is capable of being used to process an omnidirectional, horizontally polarized signal.
Figure 2B:
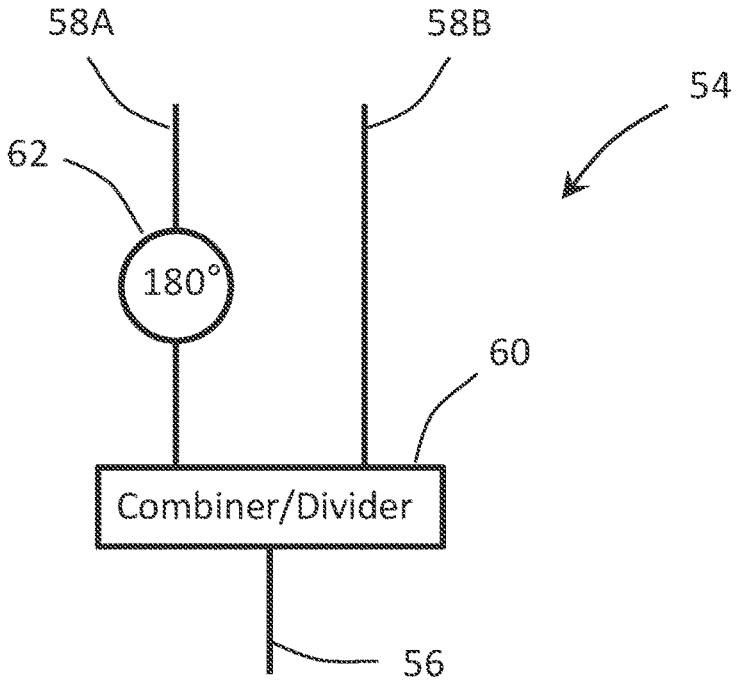
FIG. 2B is a schematic diagram of a combiner/divider circuit associated with the antenna structure shown in FIG. 2A and used to generate the signals being provided to the pair of quarter-wave patch antennas or received from the quarter-wave patch antennas to achieve the processing of an omnidirectional, horizontally polarized signal.
Figure 2C:
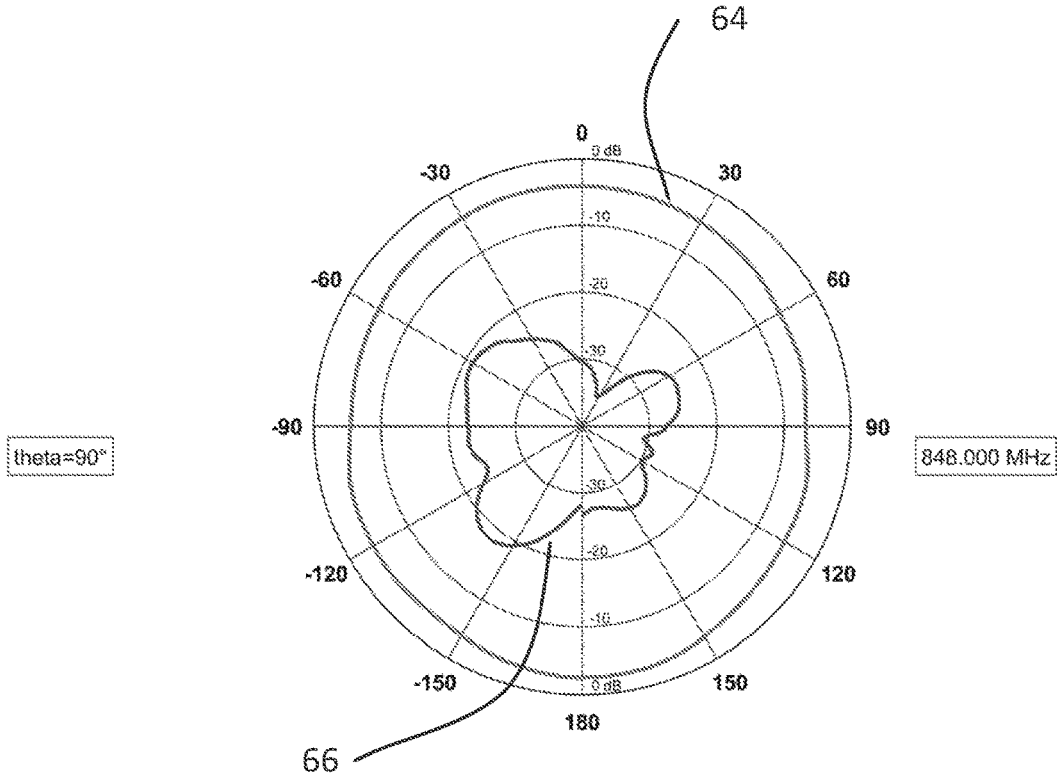
FIG. 2C illustrates the horizontally polarized signal pattern and the cross-pol signal pattern that the antenna structure shown in FIGS. 2A and 2B is capable of being used to process.

With reference to FIGS. 2A-2C, an embodiment of an antenna structure 40 comprising two, quarter-wave patch antennas and the operation of the antenna structure is described. The antenna structure 40 includes a first quarter-wave patch antenna 42A (hereinafter "antenna 42A") and a second quarter-wave patch antenna 42B (hereinafter "antenna 42B"). Antenna 42A includes a ground plane 44A, radiator patch 46A, shorting structure 48A, and feed point 50A. Similarly, antenna 42B includes a ground plane 44B, radiator patch 46B, shorting structure 48B, and feed points 50B. The antennas 42A, 42B are substantially identical to one another. Further, the antennas 42A, 42B are positioned back-to-back such that the ground planes 44A, 44B are positioned between the radiator patches 46A, 46B. More specifically, the antennas 42A, 42B are positioned so that they are mirror images of one another relative to a "mirror" plane that is coplanar with the ground planes 44A, 44B. Notably, the ground plane 44A and the 44B are the same structure in this particular embodiment of the antenna structure 40. The structure that provides the ground planes 44A, 44B, could be an integrated structure like a printed circuit board with the metallizations on the opposite sides of the board providing the ground planes for the antennas, a printed circuit board with metallization on one side of the board serving as the grounds planes for both of the antennas, or a monolithic structure, like a single piece of metal, that serves as the ground planes for both antennas.

The antenna structure 40 further includes a combiner/divider and phase shifter circuit 54 that is adapted to: (a) receive a signal from a transmitter (not shown), divide the received signal into two, substantially identical "sub-signals" that are each substantially identical to the received signal, process the two sub-signals so that there is a relative phase shift of 180±40° between the two sub-signals, and provide one of the two sub-signals to feed point 50A associated with radiator patch 46A and the other of the two sub-signals to feed point 50B associated with radiator patch 46B and (b) receive two, sub-signals, one from feed point 50A associated with radiator patch 46A and the other from feed point 50B associated with radiator patch 46B, process the two sub-signals so that there is a relative phase shift of 180±40° between the two sub-signals, combine the two sub-signals after the phase shift has been established between the two sub-signals to produce a combined signal, and provide the combined signal to a receiver or transceiver (not shown). In operation, the antenna structure 40 is capable of processing (i.e., transmitting and/or receiving) a horizontally polarized signal. As such, the circuit 54 includes (a) a transmitter/receiver/transceiver port 56 for interfacing with a transmitter, receiver, or transceiver (b) feed point ports 58A, 58B for respectively interfacing with the feed points 50A, 50B, (c) a combiner/divider 60 for combining the two sub-signals received at the feed points 50A, 50B (with the sub-signal received at feed point 50A phase shifted by 180±40°) into a single signal that is provided to a transmitter/receiver/transceiver port 56 or dividing a signal that is received at transmitter/receiver/transceiver port 56 into two sub-signals, (d) a phase-shifter 62 for imparting a 180±40° phase shift to the sub-signal received at feed port 58A or imparting a 180±40° phase shift to the sub-signal received from the combiner/divider 60 and that will subsequently be provided to feed port 58A.

Operation of the antenna structure 40 exhibits a horizontal gain pattern 64 with a non-zero gain throughout a 360° azimuth and substantially less "ripple" than the horizontal gain pattern 30 associated with the single quarter-wave patch 20 (FIG. 1B). Further, the relatively small amount of "ripple" associated with the horizontally polarized signal brings the antenna structure 40 well within 10 dB range for being considered capable of omnidirectional operation. As such, the antenna structure can be characterized as being capable of processing omnidirectional, horizontally polarized signals. Additionally, the antenna structure 40 exhibits a vertical polarized gain or cross-pol gain pattern 66 that has substantially less power gain relative to the power gain associated with the horizontally gain pattern 50. As such, the antenna structure 40 is considerably more efficient than the quarter-wave patch antenna 20. Further, the antenna structure 40 can also be characterized as processing a horizontally polarized signal as the gain pattern of the cross pol or vertically polarized signal is at least 10 dB less than the gain pattern of the horizontally polarize signal throughout the 360° range of the horizontally polarized signal.

Having described an embodiment of the antenna structure that is capable of processing an omnidirectional, horizontally polarized signal, a number of potential variations in the quarter-wave patch antennas that are used to form the antenna structure are described. However, common to each embodiment is a ground plane, a radiating patch, a shorting structure for electrically connecting the radiating patch to the ground plane, a feed point for transporting a signal to/from the radiator patch, and the greatest distance between a point at which the shorting structure establishes an electrical connection with the ground plane and a point associated with the radiator patch being about $\lambda_L/4$.

Figure 3A:
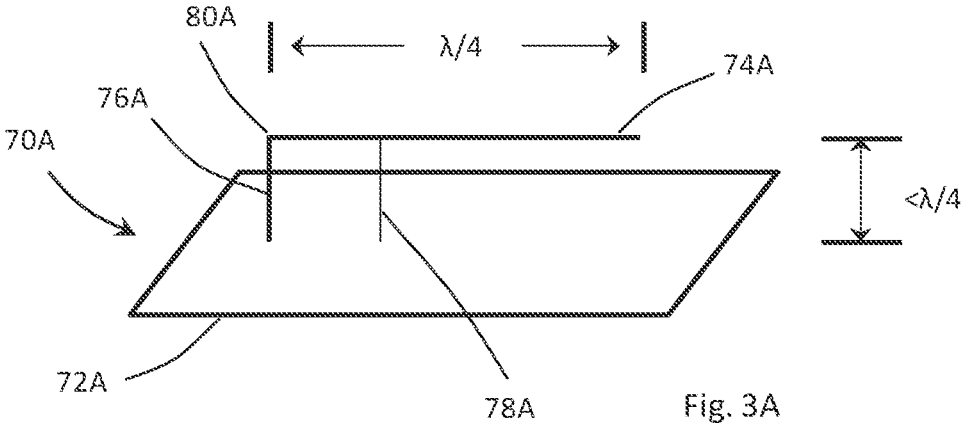
FIGS. 3A-3F are schematic diagrams of different embodiments of quarter-wave patch antenna.

With reference to FIG. 3A, an embodiment of a quarter-wave patch antenna 70A suitable for use in an antenna structure comprising two, quarter-wave patch antennas for processing an omnidirectional, horizontally polarized signal is described. The antenna 70A includes a ground plane 72A, a radiator patch 74A, a shorting structure 76A for electrically connecting the ground plane 72A and the radiator patch 74A, and a feed point 78A that provides the electrical connection for conveying a signal to and/or from the radiator patch 74A. Notably, the radiator patch 74A and shorting structure 76A are realized from a single piece of wire with a bend 80A in the wire serving as a demarcation between the radiator patch 74A and the shorting structure 76A. Further, the electrical connection between the shorting structure 76A and the ground plane 72A is established by physical contact between the shorting structure 76A and the ground plane 72A. For example, the shorting structure 76A and the ground plane 72A can be electrically connected by a solder joint. Other methods of establishing an electrical connection between the shorting structure 76A and the ground plane 72A known to those skilled in the art are also feasible. The electrical connection between the feed point 78A and the radiator patch 74A is also established by physical contact.

Figure 3B:
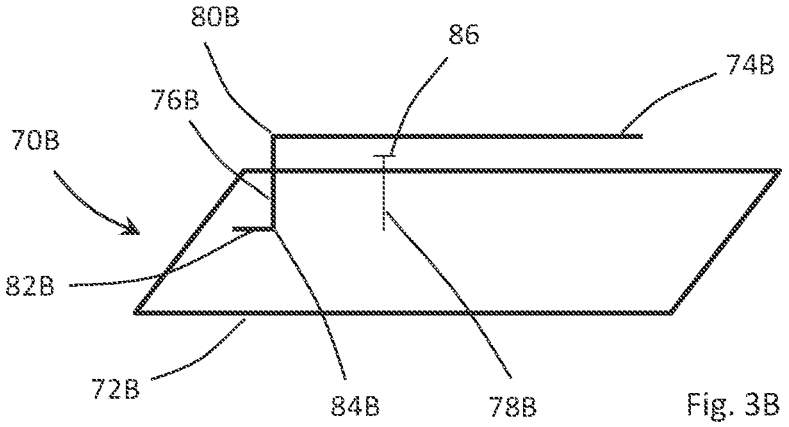

With reference to FIG. 3B, another embodiment of a quarter-wave patch antenna 70B suitable for use in an antenna structure comprising two, quarter-wave patch antennas for processing an omnidirectional, horizontally polarized signal is described. The antenna 70B includes a ground plane 72B, a radiator patch 74B, a shorting structure 76B for electrically connecting the ground plane 72B and the radiator patch 74B, and a feed point 78B that provides the electrical connection for conveying a signal to and/or from the radiator patch 74B. Notably, the radiator patch 74B and shorting structure 76B are realized from a single piece of wire with a bend 80B in the wire serving as a demarcation between the radiator patch 74B and the shorting structure 76A. Further, the electrical connection between the shorting structure 76B and the ground plane 72B is established, not by physical contact between the shorting structure 76B and the ground plane 72B, but by capacitive coupling. In this regard, the shorting structure 76B includes a capacitive coupling section 82B that begins at bend 84B and extends substantially parallel to the ground plane 72B. The electrical connection between the feed point 78B and the radiator patch 74B is also shown as being achieved by capacitive coupling. In this regard, the feed point 78B includes wire or plate 86 that is substantially parallel to the radiator patch 74B and used to establish an electrical connection for signal conveyance by capacitively coupling the feed point 78B to the radiator patch 74B during operation. Since the capacitive coupling section 82B could be of substantial length, the bend 84B is the preferred point from assessing the $\lambda_L/4$ criteria of the antenna.

Figure 3C:
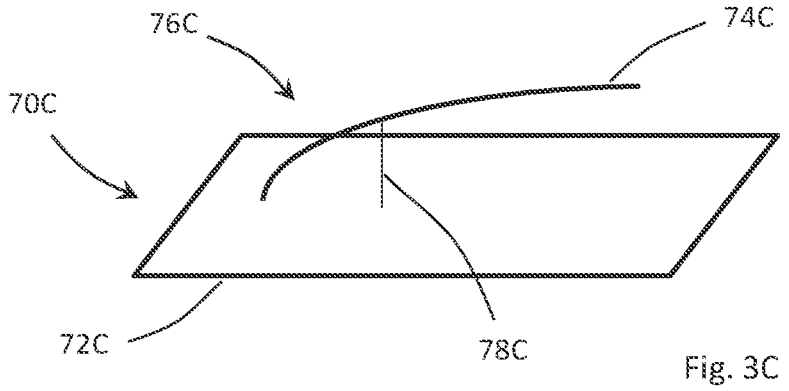

With reference to FIG. 3C, another embodiment of a quarter-wave patch antenna 70C suitable for use in an antenna structure comprising two, quarter-wave patch antennas for processing an omnidirectional, horizontally polarized signal is described. The antenna 70C includes a ground plane 72C, a radiator patch 74C, a shorting structure 76C for electrically connecting the ground plane 72C and the radiator patch 74C, and a feed point 78C that provides the electrical connection for conveying a signal to and/or from the radiator patch 74B. Notably, the radiator patch 74C and shorting structure 76C are realized from a single piece of wire. However, there is no distinct bend between the radiator patch 74C and the shorting structure 76C to serve as a demarcation between these two portions of the antenna. Nonetheless, the antenna 70C does include both the radiator patch 74C and the shorting section 76C with the demarcation between these two sections being somewhere between the ends of the wire and likely closer to the end of the wire that establishes an electrical contact with the ground plane 72C. The electrical connections between the shorting section 76C and the ground plane 72C and between the feed point 78C and the radiator patch 74C are shown as being established by physical contact. It should be appreciated that either or both of these electrical connections could be established by capacitive coupling as demonstrated with respect to antenna 70B (FIG. 3B).

Figure 3D:
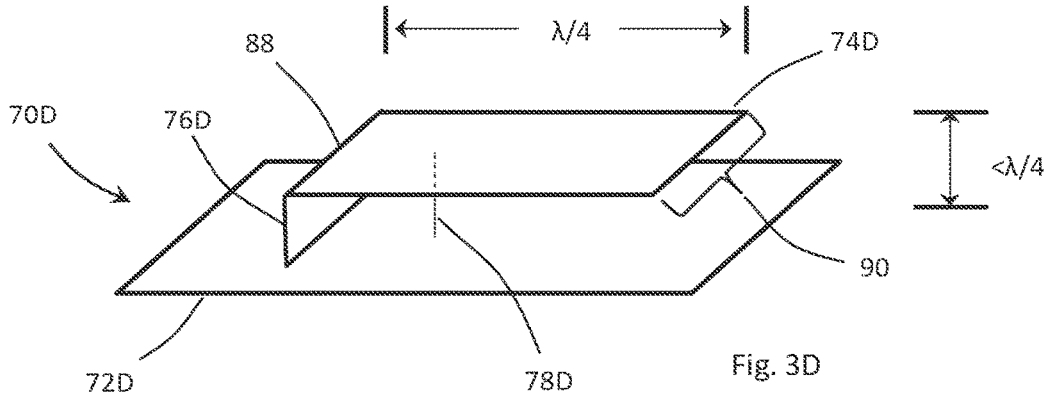

With reference to FIG. 3D, another embodiment of a quarter-wave patch antenna 70D suitable for use in an antenna structure comprising two, quarter-wave patch antennas for processing an omnidirectional, horizontally polarized signal is described. The antenna 70D includes a ground plane 72D, a radiator patch 74D, a shorting structure 76D for electrically connecting the ground plane 72D and the radiator patch 74D, and a feed point 78D that provides the electrical connection for conveying a signal to and/or from the radiator patch 74D. Notably, the radiator patch 74D and shorting structure 76D are made of a single piece of electrically conductive material (e.g., sheet metal) with a bend 88 serving as a demarcation between the radiator patch and the shorting structure. Further, the radiator patch 74D and shorting structure 76D have a width 90, that is substantially greater than the radiator patches and shorting structures shown in FIGS. 3A-3C. Generally, the width of a radiator patch and the distance of between the radiator patch and the ground plane are determinative of the bandwidth of a quarter-wave patch antenna. As such, due to the width 90 of the radiator patch 74D being substantially greater than the widths of the wires used to realize the radiator patches of the quarter-wave patch antennas 70A-70C (FIGS. 3A-3C), the antenna 70D can achieve a greater range of bandwidths than those possible with quarter-wave antennas that utilize a wire radiator patch. Moreover, for a given bandwidth, the greater width of the radiator patch 74D allows the radiator patch 74D to be positioned closer to the ground plane 72D than is possible with quarter-wave antennas that employ a wire radiator patch (e.g., antennas 70A-70C), thereby realizing a lower profile. It should be appreciated that the shorting structure 76D can be modified to implement capacitive coupling to establish the electrical connection between the shorting structure 76D and the ground plane 72D. Likewise, while the feed point 78D is shown as being physically connected to the radiator patch 74D, the feed point 78D can be modified so as to establish the electrical connection by capacitive coupling.

Figure 3E:
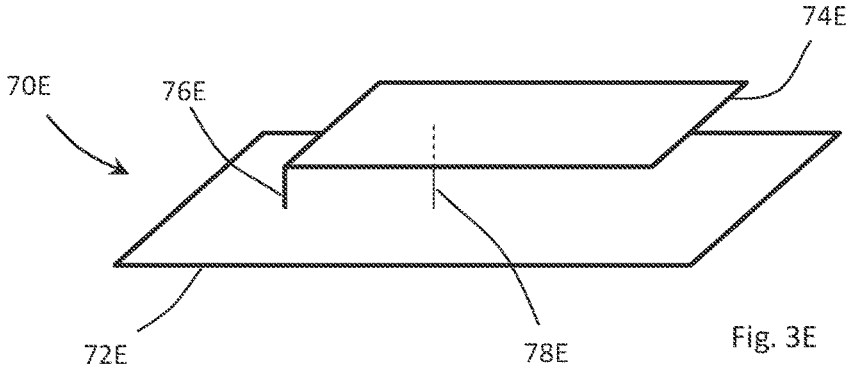

With reference to FIG. 3E, another embodiment of a quarter-wave patch antenna 70E suitable for use in an antenna structure comprising two, quarter-wave patch antennas for processing an omnidirectional, horizontally polarized signal is described. The antenna 70E includes a ground plane 72E, a radiator patch 74E, a shorting structure 76E for electrically connecting the ground plane 72E and the radiator patch 74E, and a feed point 78E that provides the electrical connection for conveying a signal to and/or from the radiator patch 74E. Notably, the shorting structure 76E of the antenna 70E employs a single pin-like structure to realize the shorting structure 76E. This pin-like structure can be realized, for example, with a threaded tube and a pair of screws one screwing passing through a hole in the radiator patch 74E and then engaging the threads associated with one end of the tube and the other screw passing through a hole associated with the ground plane 72E and then engaging the threads associated with the other end of the tube. It should be appreciated that several such column/pin-like structures can be used to establish a "wall-like" structure that could be used in place of the shorting structure 76D of antenna 70D (FIG. 3D).

Figure 3F:
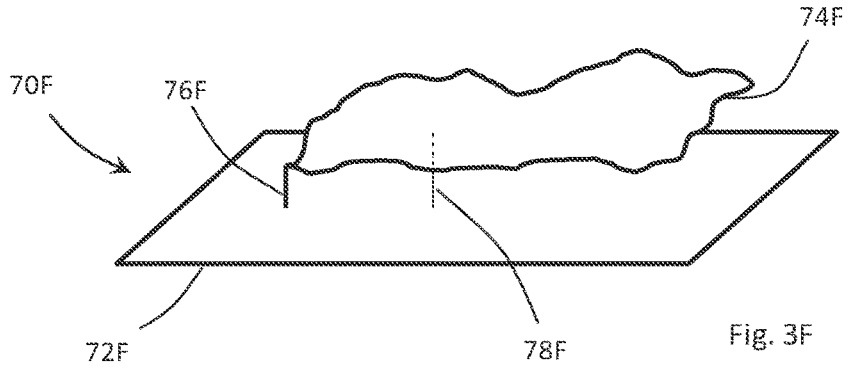

With reference to FIG. 3F, another embodiment of a quarter-wave patch antenna 70E suitable for use in an antenna structure comprising two, quarter-wave patch antennas for processing an omnidirectional, horizontally polarized signal is described. The antenna 70F includes a ground plane 72F, a radiator patch 74F, a shorting structure 76F for electrically connecting the ground plane 72F and the radiator patch 74F, and a feed point 78F that provides the electrical connection for conveying a signal to and/or from the radiator patch 74F. Notably, the radiator patch 74F does not have the rectangular shape that is characteristic of the radiator patches 74D, 74E (FIGS. 3D and 3E). Relatedly, the radiator patch 74F with its free-form shape can be associated with a shorting structure like shorting structure 74D (FIG. 3D). In which case, the shorting structure and the radiator patch 74F can be realized by bending a piece of material. Similarly, the radiator patch 74F with its free form shape and a shorting structure can be realized by bending a single piece of material such that the radiator patch and the shorting structure have a profile like the radiator patch and shorting structure like that shown in FIG. 3C.

FIGS. 3A-3F illustrate some of the quarter-wave patch antennas that can be utilized in an antenna structure that employs a pair of back-to-back, quarter-wave patch antennas. Many other configurations of quarter-wave patch antennas are possible and capable of being used in an antenna structure that employ a pair of back-to-back, quarter-wave patch antennas.

Figure 4A:
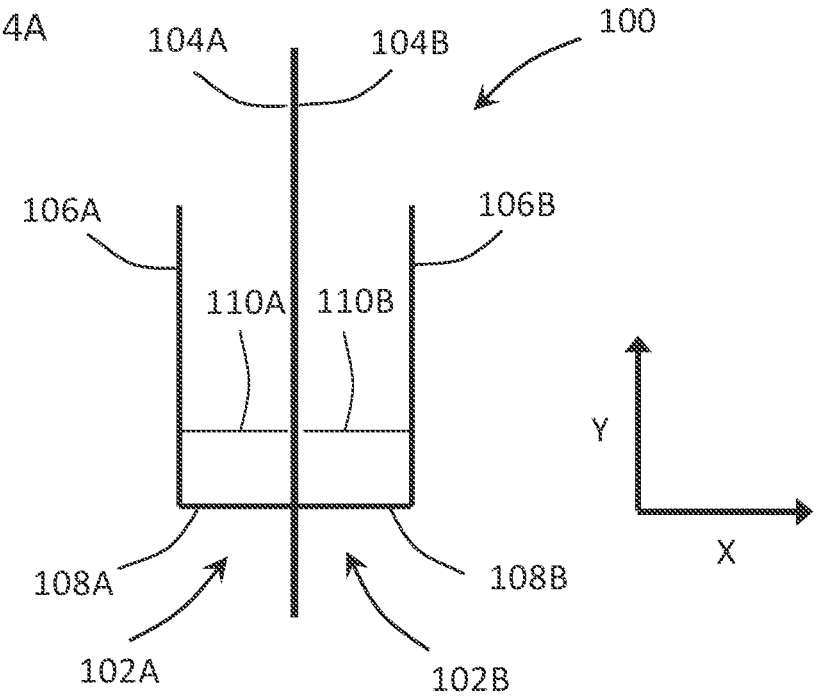
FIG. 4A is a schematic diagram of a first embodiment of an antenna structure that employs two, quarter-wave patch antennas (i.e., an antenna pair) and is capable of being used to process an omnidirectional, horizontally polarized signal.

While several different types of quarter-wave patch antennas can be employed in an antenna structure with back-to-back, quarter-wave patch antennas that is capable of processing omnidirectional, horizontally polarized signal, there are also several variations in the positional relationships of the back-to-back, quarter-wave patch antennas that can be employed and acceptable omnidirectional, horizontally polarized signal processing still realized. With reference to FIG. 4A, these positional variations are described relative to a reference antenna structure 100 with back-to-back, quarter-wave patch antennas 102A, 102B. The antennas 102A, 102B are each of the type of quarter-wave patch antenna 70D shown in FIG. 3D. Further, the antennas 102A, 102B are substantially identical to one another. The antenna 102A comprises a ground plane 104A, radiator patch 106A, shorting structure 108A, and feed point 110A. Likewise, the antenna 102B comprises a ground plane 104B, a radiator patch 106B, shorting structure 108B, and feed point 110B. The antennas 102A, 102B are positioned back-to-back such that the ground planes 104A, 104B are positioned between the radiator patches 106A, 106B and, if the shorting structures 108A, 108B are considered to form a single structure, the radiator patches 106A, 106B both extend away from this structure in substantially the same direction. Additionally, the ground planes 104A, 104B of the antennas 102A, 102B are coplanar (e.g., a single sheet of metal serves as the ground plane for both of the quarter-wave patch antennas), and the antennas 102A, 102B are mirror images of one another with the "mirror" being coplanar with the ground planes.

With reference to FIGS. 4B-4G, potential variations in the positional relationships of antennas 102A, 102B of the reference antenna structure 100 that yield antenna structures with back-to-back, quarter-wave patch antennas capable of being used to process an omnidirectional, horizontally polarized signal are described.

Figure 4B:
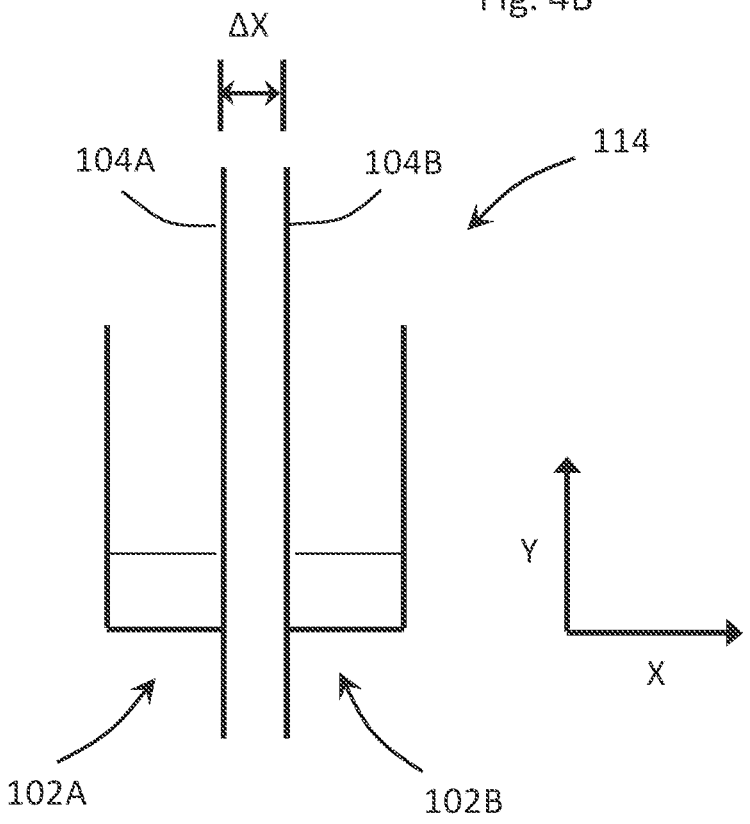
FIGS. 4B-4D illustrate translational variations in the positions of the two, quarter-wave patch antenna shown in FIG. 4A that can be tolerated and omnidirectional, horizontally polarized signal operation achieved.

With reference to FIG. 4B, antenna structure 114 includes the two, quarter-wave patch antennas 102A, 102B of FIG. 4A. However, the ground planes 104A, 104B of antennas 102A, 102B are now separated from one another by a distance Δx. As such, the antenna structure 114 reflects a translational change in the position of antennas 102A, 102B along an x-axis that has resulted in a separation of the ground planes 104A, 104B by the amount Δx. The antenna structure 114 is capable of processing an omnidirectional, horizontally polarized signal for a Δx of up to $\lambda_L/4$, where $\lambda_L$ is the wavelength associated with the frequency that defines the low end of the bandwidth for the antenna structure.

Figure 4C:
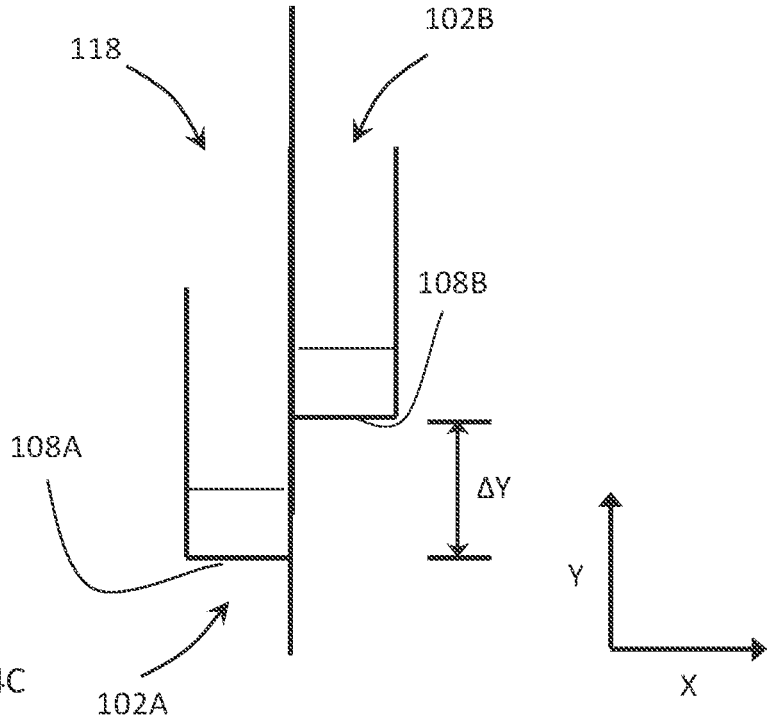

With reference to FIG. 4C, antenna structure 118 includes the two, quarter-wave patch antennas 102A, 102B of FIG. 4A. However, the shorting structures 108A, 108B of antennas 102A, 102B are now separated from one another by a distance Δy. As such, the antenna structure 118 reflects a translational change in the position of antennas 102A, 102B along a y-axis that has resulted in a separation of the shorting structures 108A, 108B by the amount Δy. The antenna structure 118 is capable of processing an omnidirectional, horizontally polarized signal for a Δy of up to $\lambda_L/4$.

Figure 4D:
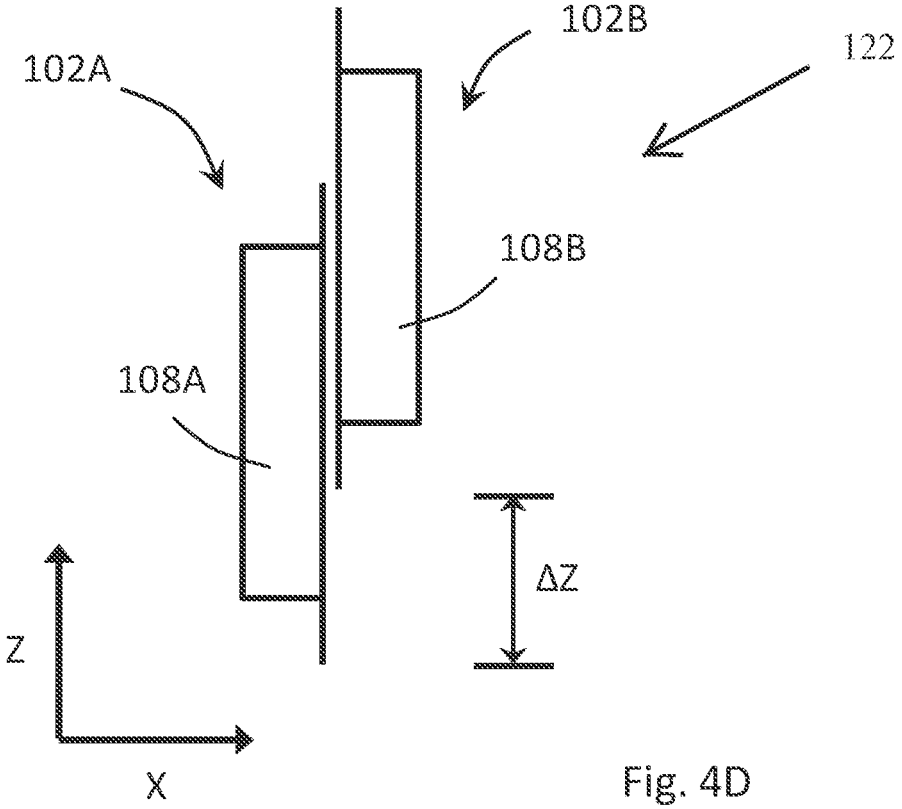

With reference to FIG. 4D, antenna structure 122 includes the two, quarter-wave patch antennas 102A, 102B of FIG. 4A. However, the shorting structures 108A, 108B of antennas 102A, 102B are now separated from one another by a distance Δz. As such, the antenna structure 122 reflects a translational change in the position of antennas 102A, 102B along a z-axis that has resulted in a separation of the shorting structures 108A, 108B by the amount Δz. The antenna structure 122 is capable of processing an omnidirectional, horizontally polarized signal for a Δz of up to $\lambda_L/4$.

Figure 4E:
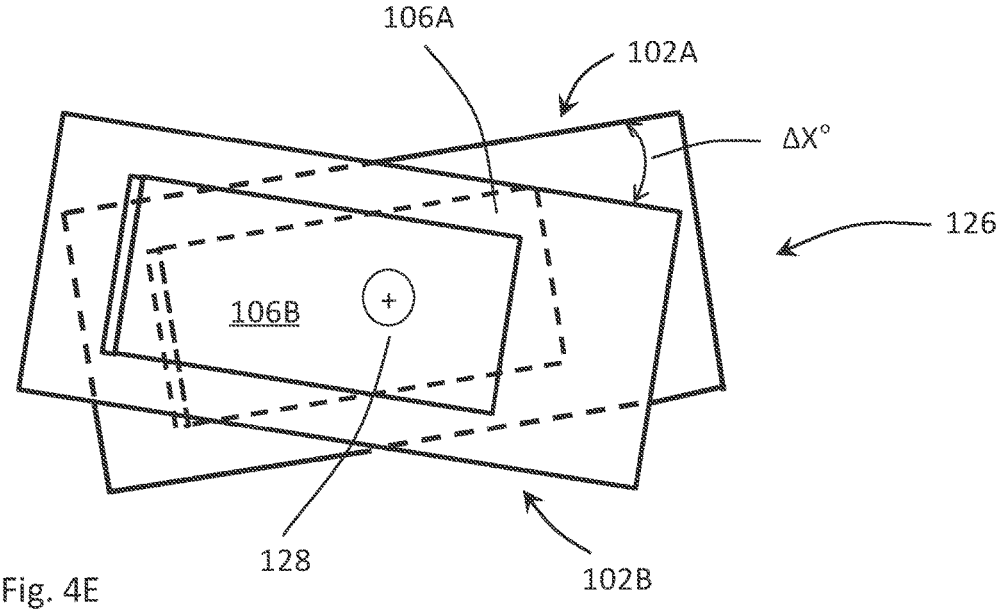

With reference to FIG. 4E, antenna structure 126 includes the two, quarter-wave patch antennas 102A, 102B of FIG. 4A. However, relative to an arbitrary x-axis 128 that is perpendicular to the ground planes 104A, 104B, the antennas 102A, 102B have been rotated relative to one another by an angle Δx°. As such, the antenna structure 122 reflects a rotational change in the position of antennas 102A, 102B about the arbitrary x-axis. The antenna structure 122 is capable of processing an omnidirectional, horizontally polarized signal for a Δx° of up to 30°.

Figure 4F:
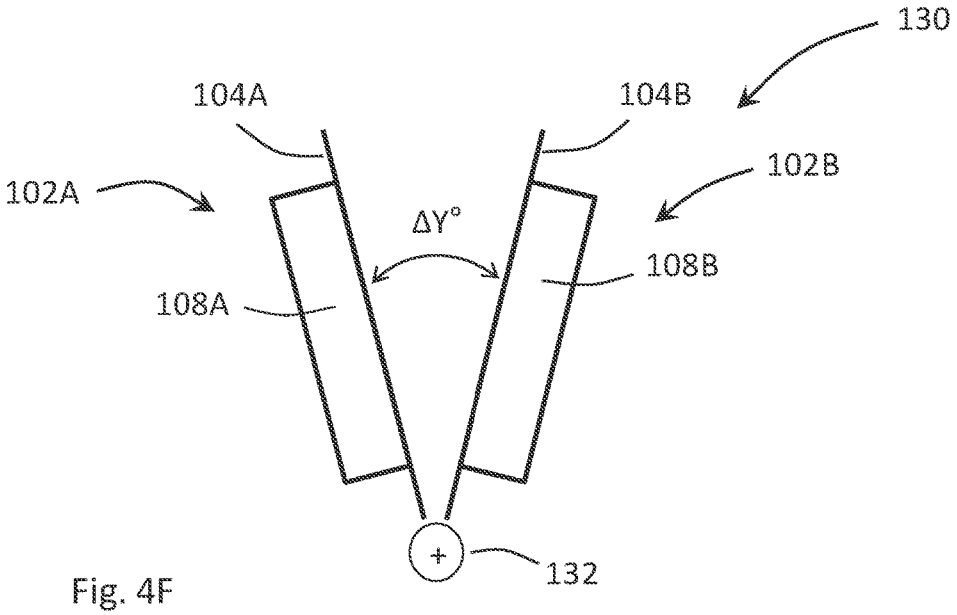

With reference to FIG. 4F, antenna structure 130 includes the two, quarter-wave patch antennas 102A, 102B of FIG. 4A. However, relative to an arbitrary y-axis 132 that is parallel to the ground planes 104A, 104B and perpendicular to the x-axis and the z-axis, the antennas 102A, 102B have been rotated relative to one another by an angle Δy°. As such, the antenna structure 130 reflects a rotational change in the position of antennas 102A, 102B about the y-axis. The antenna structure 130 is capable of processing an omnidirectional, horizontally polarized signal for a Δy of up to 30°.

With reference to FIG. 4G, antenna structure 134 includes the two, quarter-wave patch antennas 102A, 102B of FIG. 4A. However, relative to an arbitrary z-axis 136 that is parallel to the ground planes 104A, 104B and perpendicular to the x-axis, the antennas 102A, 102B have been rotated relative to one another by an angle Δz°. As such, the antenna structure 122 reflects a rotational change in the position of antennas 102A, 102B about the z-axis. The antenna structure 130 is capable of processing an omnidirectional, horizontally polarized signal for a Δz of up to 30°.

With reference to FIG. 4H, antenna structure 138 includes the two, quarter-wave patch antennas 102A, 102B of FIG. 4A. However, relative to an arbitrary z-axis 140 that is parallel to the ground planes 104A, 104B and perpendicular to the x-axis, the antennas 102A, 102B have been rotated relative to one another by an angle Δz°. As such, the antenna structure 122 reflects a rotational change in the position of antennas 102A, 102B about the y-axis. The antenna structure 130 is capable of processing an omnidirectional, horizontally polarized signal for a Δz of up to 30°.

An antenna structure with back-to-back patch antennas that is capable of processing omnidirectional, horizontally polarized signals can have any one of the above-noted translational and rotational variations in the positions of the quarter-wave patch antennas and process omnidirectional, horizontally polarized signals. However, an antenna structure with back-to-back antennas that has two or more of the translation and rotational variations in the positions of the quarter-wave patch antennas may not be capable of processing omnidirectional, horizontally polarized signals. In such situations, an iterative process is likely to be needed to determine the extent of the variations that can be tolerated and omnidirectional, horizontally polarized signal processing achieved. For instance, if two translational variations are needed or desirable, an initial variation in each translation can be made/modeled and a determination made as to whether omnidirectional, horizontally polarized signal processing is obtained. If not, then reductions in the translations can be made/modeled and an assessment made as to whether omnidirectional, horizontally polarized signal processing has been achieved. Iteratively changing the variations can be repeated until the envelope for omnidirectional, horizontally polarized signal operation for the two translations is determined. If the initial variations in each translation did yield omnidirectional, horizontally polarized operation, the extent of the translations can be increased incrementally to determine when omnidirectional, horizontally polarized operation is not obtained. Further, while the descriptions of the various translational and rotational variations in the positions of the quarter-wave patch antennas were described with respect to embodiments of the back-to-back patch antennas in which the quarter-wave patch antennas were substantially identical to one another, the quarter-wave patch antennas need not be identical to one another. For instance, an antenna structure with back-to-back antennas in which one of the quarter-wave patch antenna is of the type shown in FIG. 3A and the other quarter wave patch antenna is of the type shown in FIG. 3D is possible. A fundamental concern with respect to such an antenna structure is that the respective bandwidths of the of the two quarter-wave patch antennas must overlap with one another and the overlapping portion of the bandwidths must include the bandwidth that the antenna structure is designed to service.

Antenna structures having two pairs of quarter-wave patch antennas or two pairs of back-to-back antennas can be used to process a selected one of: (a) an omnidirectional, horizontally polarized beam pattern, (b) a forward end-fire, horizontally polarized beam pattern, (c) an aftward end-fire, horizontally polarized beam pattern, (d) a port side, horizontally polarized beam pattern, and (e) a starboard side, horizontally polarized beam pattern by appropriate control of the signals applied to each of the four feed points in such an antenna structure. Further, such antenna structures can be used to process a selected one of a subset of these beam patterns by limiting the control of the signals applied to each of the four feed points.

With reference to FIGS. 5A-5D, an antenna structure with two pairs of back-to-back antennas 200 that is capable of being used to process a selected one of the five horizontally polarized beam patterns is described. The antenna structure 200 includes a first pair of back-to-back antennas 202 and second pair of back-to-back antennas 222. The first pair of back-to-back antennas 202 is substantially identical to the antenna structure 100 (FIG. 4A). Further, the first pair of back-to-back antennas 202 is substantially identical to the second pair of back-to-back antennas 222. The first pair of back-to-back antennas 202 comprises ground planes 204A, 204B, radiator patches 206A, 206B, shorting structures 208A, 208B, and feed points 210A, 210B. Likewise, the second pair of back-to-back antennas 222 comprises ground planes 224A, 224B, radiator patches 226A, 226B, shorting structures 228A, 228B, and feed points 230A, 230B. Characteristic of antenna structure 200 is that: (a) the shorting structures 228A, 228B are located between radiator patches 206A, 206B and radiator patches 226A, 226B, (b) the radiator patches 206A, 206B are located between shorting structures 208A, 208B and shorting structures 228A, 228B (c) the ground planes 204A, 224A are aligned, (d) the ground planes 204B, 224B are aligned, and (e) the radiator patches 206A, 226A are aligned and (f) the radiator patch 226A, 226B are aligned. Further, the distance between radiating edges 212A, 212B of the first pair of back-to-back antennas 202A and radiating edges 232A, 232B of the second pair of back-to-back antennas 222A is about $\lambda_L/4$. Even though the length of the radiating patch 206A is about $\lambda_L/4$ and the distance between the radiating edges is also about a $\lambda_L/4$, the radiating edges 212A, 212B of the first pair of back-to-back antennas 202 must be spaced from the shorting structures 208A, 208B and radiating patches 226A, 226B of the second pair of back-to-back antennas 222.

In the illustrated embodiment, the ground planes 204A, 204B, 224A, 224B are embodied on a single, monolithic/integrated structure 234 (e.g., a single metal plate or a printed circuit board with the metallization on one side of the board serving as the ground planes for each of the quarter-wave patch antennas). A separate ground plane for each of the quarter-wave patch antennas is feasible. Also, a separate ground plane structure for each of the first pair of back-to-back antennas 202 and the second pair of back-to-back antennas 222 is feasible. Such separate ground planes can be embodied on the single, monolithic/integrated structure 234, on four separate structures, or on less than four separate structures with one of the structures providing the ground planes for two or more of the quarter-wave patch antennas. The single, monolithic/integrated structure 234 used to realize the ground planes 204A, 204B, 224A, and 224B is shown as extending substantially beyond the area underlying the radiator patches 206A, 206B, 226A, and 226B. In this embodiment, the single, monolithic/integrated structure 234 serves to support the first and second pairs of back-to-back antennas 202A, 222A at a desired distance above a surface (e.g., the exterior surface of an aircraft). As such, the monolithic/integrated structure 234 also serves as a stand or as a portion of a stand for the back-to-back antennas 202A, 222A.

While each of the quarter-wave patch antennas associated with the first and second pairs of antennas 202 and 222 are substantially identical to one another, these antennas need not be identical to one another and each can take on one of the forms shown in FIGS. 3A-3F or any other form of quarter-wave patch antenna, provided all of the quarter-wave patch antennas have a common overlapping bandwidth that satisfies the bandwidth needed for the antenna structure 200.

Translational and rotational deviations in the positions of the quarter-wave patch antennas forming each of the first and second pairs of antennas 202 and 222 can be accommodated and omnidirectional, horizontally polarized signal operation achieved, as discussed with respect to FIGS. 4A-4H. However, the extent of translational and/or rotational deviations that can be tolerated and omnidirectional, horizontally polarized signal processing achieved may be more limited when positional deviations are needed in two or more of the six degrees of freedom. In such cases, an iterative approach may be needed to determine the extent of the positional deviations that can be tolerated in each of degree of freedom for which a deviation is needed and omnidirectional, horizontally polarized signal operation achieved.

Further, translational and rotational deviations in the positions of the first and second pairs of antennas 202, 222 can be accommodated and omnidirectional, horizontally polarized signal operation achieved. In this regard, the deviation in the rotational position of each of the quarter-wave patch antennas associated with both the first and second pairs of antennas 202, 222 must be within a 30° range with respect to each of the other quarter-wave patch antennas in the antenna structure 200 for a selected one of the x-y-z dimensions. With respect to the translational deviations in the positions of quarter-wave patch antennas associated with the first and second pairs of antennas 202, 222, each of the quarter-wave patch antennas associated with the first and second pairs of antennas 202, 222 must satisfy the $\lambda_L/4$ translational deviation limitation with respect to each of the other quarter-wave patch antennas for a selected one of the x-y-z dimensions. However, the extent of translational and/or rotational deviations that can be tolerated and omnidirectional, horizontally polarized signal processing achieved may be more limited when positional deviations are needed in two or more of the six degrees of freedom. In such cases, an iterative approach may be needed to determine the extent of the positional deviations that can be tolerated in each degree of freedom for which a deviation is needed and omnidirectional, horizontally polarized signal operation achieved.

With reference to FIGS. 5C and 5D, the ability of the antenna structure 200 to be used to process a selected one of: (a) an omnidirectional, horizontally polarized beam pattern, (b) a forward end-fire, horizontally polarized beam pattern, (c) an aftward end-fire, horizontally polarized beam pattern, (d) a port side, horizontally polarized beam pattern, and (e) a starboard side, horizontally polarized beam pattern by appropriate control of the signals applied to each of the four feed points in such an antenna structure is described. As shown in FIG. 5C, the feed points 210A, 210B, 230A, 230B of the antenna structure 200 are respectively identified as ports 1, 2, 3, and 4. Further, the antenna 200 is assumed to be oriented such that an axis 236 of the antenna structure 200 is oriented parallel to the roll axis of an aircraft and the second pair of antennas 222 is closer to the nose of the aircraft than the first pair of antennas 202. The axis 236 of the antenna structure 200 is a line that lies in the plane of the monolithic structure 234 that embodies the ground plane(s) for the each of the quarter-wave patch antennas and intersects the two lines defined by the first pair of feed points 210A, 210B and the second pair of feed points 230A, 230B. When the quarter-wave patch antennas forming the antenna structure 200 are not identical to one another and/or there are one or more positional deviations in the positions of the quarter-wave patch antennas forming the antenna structure 200, an axis of the antenna structure is identified by whatever orientation of the antenna structure 200 yields the omnidirectional, horizontally polarized beam pattern with the least ripple. By appropriately controlling the signals applied to the ports 1-4 of the antenna structure 200, any one of five beam patterns can be processed by the antenna. To elaborate, if a 0° phase shift signal is associated with port 1, a 180° phase shift signal is associated with port 2, and ports 3 and 4 are turned "off," the antenna structure 200 is adapted for processing an omnidirectional, horizontally polarized signal. The term "off" associated with one of the ports preferably means that the transmission line associated with port has been switched to a load that matches the characteristic impedance of the transmission line. However, simply switching the transmission line out of the circuit so that a signal does not reach the port may also yield adequate performance. The port, starboard, fore, and aft beam patterns are each obtained by applying the combination of phase shifted signals and "off" signals to the ports 1-4 as shown in the table of FIG. 5D. With respect to each of the directional beam patterns (fore, aft, port, and starboard), the non-zero, phase shifted signals shown in the table can deviate by as much as ±40° relative to the 0° phase-shifted signal and a directional beam pattern achieved. As noted with respect to FIG. 2C, a deviation in the 180° phase shift of ±40° can be tolerated and an omnidirectional, horizontally polarized beam realized.

With reference to FIGS. 6A-6D, an antenna structure with two pairs of back-to-back antennas 300 that is capable of being used to process a selected one of the five horizontally polarized beam patterns is described. The antenna structure 300 includes a first pair of back-to-back antennas 302 and second pair of back-to-back antennas 322. The first pair of back-to-back antennas 302 is substantially identical to the antenna structure 100 (FIG. 4A). Further, the first pair of back-to-back antennas 302 is substantially identical to the second pair of back-to-back antennas 322. The first pair of back-to-back antennas 302 comprises ground planes 304A, 304B, radiator patches 306A, 306B, shorting structures 308A, 308B, and feed points 310A, 310B. Likewise, the second pair of back-to-back antennas 322 comprises ground planes 324A, 324B, radiator patches 326A, 326B, shorting structures 328A, 328B, and feed points 330A, 330B. Characteristic of antenna structure 300 is that: (a) the radiator patches 306A, 306B, 326A, 326B are located between the shorting structures 308A, 308B and the shorting structures 328A, 328B, (b) the ground planes 304A, 324A are aligned, (c) the ground planes 304B, 324B are aligned, and (d) the radiator patches 306A, 326A are aligned, and (e) the radiator patch 326A, 326B are aligned. The antenna structure 300 also includes an isolator 340 with an I-like shape that has a top cross bar 342A that is aligned with radiator patches 306A, 316A and a bottom cross bar 342B that is aligned with the radiator patches 306B, 316B. Further, the distance between radiating edges 312A, 312B of the first pair of back-to-back antennas 302 and radiating edges 332A, 332B of the second pair of back-to-back antennas 322 is greater than 0 and less $\lambda_L/2$ with $\lambda_L/4$ being optimal. It should be noted that, the closer the distance is to 0 or $\lambda_L/2$, the worse the performance of the antenna. In certain embodiments, the isolator 340 may be unnecessary. However, the need for an isolator to prevent coupling between the first and second pairs of back-to-back antennas 302, 322 increases as the distance between the radiating edges 312A, 312B and radiating edges 332A, 332B decreases.

In the illustrated embodiment, the ground planes 304A, 304B, 324A, 324B are embodied on a single, monolithic/integrated structure 334 (e.g., a single metal plate or a printed circuit board with the metallization on one side of the board serving as the ground planes for each of the quarter-wave patch antennas). A separate ground plane for each of the quarter-wave patch antennas is feasible. Also, a separate ground plane structure for each of the first pair of back-to-back antennas 302 and the second pair of back-to-back antennas 322 is feasible. Such separate ground planes can be embodied on the single, monolithic/integrated structure 334, on four separate structures, or on less than four separate structures with one of the structures providing the ground planes for two or more of the quarter-wave patch antennas. The single, monolithic/integrated structure 334 used to realize the ground planes 304A, 304B, 324A, and 324B is shown as extending substantially beyond the area underlying the radiator patches 306A, 306B, 326A, and 326B. In this embodiment, the single, monolithic/integrated structure 334 serves to support the first and second pairs of back-to-back antennas 302, 322 at a desired distance above a surface (e.g., the exterior surface of an aircraft). As such, the monolithic/integrated structure 334 also serves as a stand or as a portion of a stand for the back-to-back antennas 302A, 322A.

While each of the quarter-wave patch antennas associated with the first and second pairs of antennas 302 and 322 are substantially identical to one another, these antennas need not be identical to one another and each can take on one of the forms shown in FIGS. 3A-3F or any other form of quarter-wave patch antenna, provided all of the quarter-wave patch antennas have a common overlapping bandwidth that satisfies the bandwidth needed for the antenna structure 300.

Translational and rotational deviations in the positions of the quarter-wave patch antennas forming each of the first and second pairs of antennas 302 and 322 can be accommodated and omnidirectional, horizontally polarized signal operation achieved, as discussed with respect to FIGS. 4A-4H. However, the extent of translational and/or rotational deviations that can be tolerated and omnidirectional, horizontally polarized signal processing achieved may be more limited when positional deviations are needed in two or more of the six degrees of freedom. In such cases, an iterative approach may be needed to determine the extent of the positional deviations that can be tolerated in each of degree of freedom for which a deviation is needed and omnidirectional, horizontally polarized signal operation achieved.

Further, translational and rotational deviations in the positions of the first and second pairs of antennas 302, 322 can be accommodated and omnidirectional, horizontally polarized signal operation achieved. In this regard, the deviation in the rotational position of each of the quarter-wave patch antennas associated with both the first and second pairs of antennas 302, 322 must be within a 30° range with respect to each of the other quarter-wave patch antennas in the antenna structure 300 for a selected one of the x-y-z dimensions. With respect to the translational deviations in the positions of quarter-wave patch antennas associated with the first and second pairs of antennas 302, 322, each of the quarter-wave patch antennas associated with the first and second pairs of antennas 302, 322 must satisfy the $\lambda_L/4$ translational deviation limitation with respect to each of the other quarter-wave patch antennas for a selected one of the x-y-z dimensions. However, the extent of translational and/or rotational deviations that can be tolerated and omnidirectional, horizontally polarized signal processing achieved may be more limited when positional deviations are needed in two or more of the six degrees of freedom. In such cases, an iterative approach may be needed to determine the extent of the positional deviations that can be tolerated in each degree of freedom for which a deviation is needed and omnidirectional, horizontally polarized signal operation achieved.

The isolator 340, when employed, can take many positions that deviate rotationally and/or translationally from the position shown in FIG. 6A and relative to the first and second pairs of back-to-back antennas 302, 322. The efficacy of any such deviations in the position of the isolator 340 is determined based on whether coupling between the first and second pairs of back-to-back antennas 302, 322 is avoided or sufficiently suppressed for a particular application.

With reference to FIGS. 6C and 6D, the ability of the antenna structure 300 to be used to process a selected one of: (a) an omnidirectional, horizontally polarized beam pattern, (b) a forward end-fire, horizontally polarized beam pattern, (c) an aftward end-fire, horizontally polarized beam pattern, (d) a port side, horizontally polarized beam pattern, and (e) a starboard side, horizontally polarized beam pattern by appropriate control of the signals applied to each of the four feed points in such an antenna structure is described. As shown in FIG. 6C, the feed points 310A, 310B, 330A, 330B of the antenna structure 300 are respectively identified as ports 1, 2, 3, and 4. Further, the antenna 320 is oriented such that an axis 336 of the antenna is oriented so as to be parallel to the roll axis of an aircraft and the second pair of antennas 322 is closer to the nose of the aircraft than the first pair of antennas 302. The axis 336 of the antenna structure 300 is a line that lies in the plane of the monolithic structure 334 that embodies the ground plane(s) for the each of the quarter-wave patch antennas and intersects the two lines defined by the first pair of feed points 310A, 310B and the second pair of feed points 330A, 330B. When the quarter-wave patch antennas forming the antenna structure 300 are not identical to one another and/or there are one or more positional deviations in the positions of the quarter-wave patch antennas forming the antenna structure 300, the axis of the antenna structure is identified by whatever orientation of the antenna yields the omnidirectional, horizontally polarized signal processing with the least ripple. By appropriately controlling the signals applied to the ports 1-4 of the antenna structure 300, any one of five beam patterns can be processed by the antenna. To elaborate, if a 0° phase shift signal is associated with port 1, a 180° phase shift signal is associated with port 2, and ports 3 and 4 are turned "off," the antenna structure 300 is adapted for processing an omnidirectional, horizontally polarized signal. The term "off" associated with one of the ports preferably means that the transmission line associated with port has been switched to a load that matches the characteristic impedance of the transmission line. However, simply switching the transmission line out of the circuit so that a signal does not reach the port may also yield adequate performance. The port, starboard, fore, and aft beam patterns are obtained by applying the combination of phase shifted signals and "off" signals to the ports 1-4 as shown in the table of FIG. 6D. With respect to each of the directional beam patterns (fore, aft, port, and starboard), the non-zero, phase shifted signals shown in the table can deviate by as much as ±40° relative to the 0° phase-shifted signal and a directional beam pattern achieved. As noted with respect to FIG. 2C, a deviation in the 180° phase shift of ±40° can be tolerated and an omnidirectional, horizontally polarized beam realized.

Figures 6E, 6F:
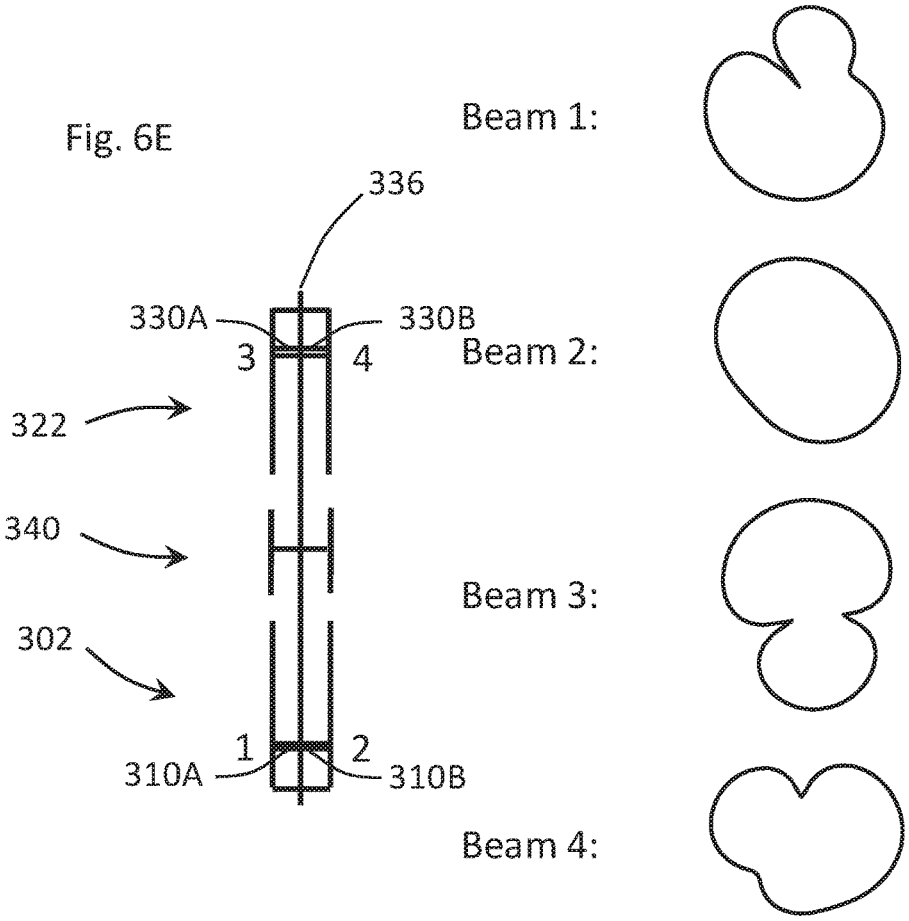
FIGS. 6E-6F illustrate the beam patterns that can be generated by the application of various phase shifts to the input ports associated with the second embodiment of the antenna structure shown in FIG. 6A.
Figures 9A, 9B, 9C, 9D:
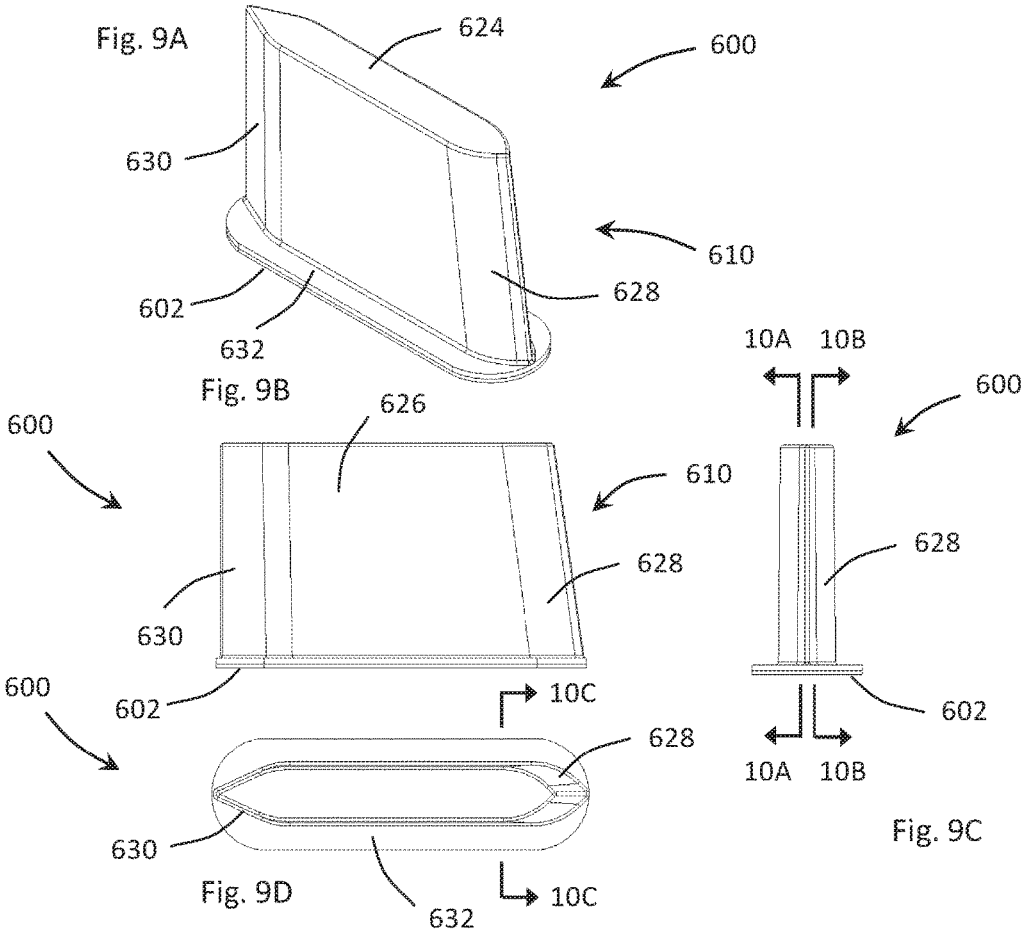
FIGS. 9A-9D respectively are perspective, side, front, and top views of an embodiment of an antenna structure that includes two pairs of back-to-back, quarter-wave patch antennas of the type shown in FIGS. 6A-6D, a stand for use in disposing the two pairs of back-to-back quarter-wave patch antennas at a desired distance above a surface, and a radome for protecting the two pairs of back-to-back, quarter-wave patch antennas from external conditions.

With reference to FIGS. 6E and 6F, the antenna structure 300 can also be used to generate many different beam patterns by the application of different phase shifts to two or more of the feed points 310A, 310B, 330A, and 330B than the 0°, 90°, 180°, and 270° phase shifts discussed with respect to FIGS. 6C and 6D. FIG. 6F shows four combinations of phase shifts that can be applied to the ports 1-4 and FIG. 6E shows the resulting four beam patterns that result from the four combinations of phase shifts applied to ports 1-4. Other combinations of phase shifts applied to ports 1-4 will produce yet additional beam patterns. The resulting beam patterns have features that may be useful in certain applications. For instance, beam 3 has significant lobes in the fore and aft directions and significant nulls in the port and starboard directions. As such, applying the phase shifts associated with beam 3 to the ports 1-4 may be useful in, for instance, conducting communications with transceivers in the fore and aft directions while precluding or making difficult communications with transceivers in the port and starboard. It should be appreciated that the application of phase shifts other than the 0°, 90°, 180°, and 270° phase shifts can be applied to other of the antenna structures described herein that have two or more ports to generate various beam patterns. Further, certain combinations of phase shifts can be applied to the ports 1-4 of antenna structure 300 to steer the resulting beam through a 360° azimuthal range. Comparable phase shifts can be applied to the other two port and four port antenna structures described to achieve beam steering. Further, the antenna structure 300 can also be employed in radio systems that employ multi-input and multi-output (MIMO) processing. In this regard, the ports 1-4 can be operatively connected to a MIMO manifold in such a system. Likewise, the other antenna structures described herein with two ports (e.g., antenna structure 100) and four ports (e.g., antenna structures 200, 400, 500) can be employed in a MIMO system in which the ports are operatively connected to a MIMO manifold.

With reference to FIGS. 7A-7D, an antenna structure with two pairs of back-to-back antennas 400 that is capable of being used to process a selected one of the five horizontally polarized beam patterns is described. The antenna structure 400 includes a first pair of back-to-back antennas 402 and second pair of back-to-back antennas 422. The first pair of back-to-back antennas 402 is substantially identical to the antenna structure 100 (FIG. 4A). Further, the first pair of back-to-back antennas 402 is substantially identical to the second pair of back-to-back antennas 422. The first pair of back-to-back antennas 402 comprises ground planes 404A, 404B, radiator patches 406A, 406B, shorting structures 408A, 408B, and feed points 410A, 410B. Likewise, the second pair of back-to-back antennas 422 comprises ground planes 424A, 424B, radiator patches 426A, 426B, shorting structures 428A, 428B, and feed points 430A, 430B. Characteristic of antenna structure 400 is that: (a) the ground planes 404A, 424A are aligned, (b) the ground planes 404B, 424B are aligned, (c) radiator patches 406A, 426A are aligned, (d) the radiator patches 406B, 426B are aligned, (d) the shorting structures 408A, 408B are substantially perpendicular to the radiator patches 406A, 406B, (e) the shorting structures 428A, 428B substantially perpendicular to the radiator patches 426A, 426B, (f) the shorting structures 408A, 408B are coplanar with a plane defined by the ends of the radiator patches 426A, 426B, and (g) the shorting structures 428A, 428B are coplanar with a plane defined by the ends of the radiator patches 406A, 406B.

In the illustrated embodiment, the ground planes 404A, 404B, 424A, 424B are embodied on a single, monolithic/integrated structure 434 (e.g., a single metal plate or a printed circuit board with the metallization on one side of the board serving as the ground planes for each of the quarter-wave patch antennas). A separate ground plane for each of the quarter-wave patch antennas is feasible. Also, a separate ground plane structure for each of the first pair of back-to-back antennas 402 and the second pair of back-to-back antennas 422 is feasible. Such separate ground planes can be embodied on the single, monolithic/integrated structure 434, on four separate structures, or on less than four separate structures with one of the structures providing the ground planes for two or more of the quarter-wave patch antennas. The single, monolithic/integrated structure 434 used to realize the ground planes 404A, 404B, 424A, and 424B is shown as extending substantially beyond the area underlying the radiator patches 406A, 406B, 426A, and 426B. In this embodiment, the single, monolithic/integrated structure 434 serves to support the first and second pairs of back-to-back antennas 402, 422 at a desired distance above a surface (e.g., the exterior surface of an aircraft). As such, the monolithic/integrated structure 434 also serves as a stand or as a portion of a stand for the back-to-back antennas 402A, 422A.

While each of the quarter-wave patch antennas associated with the first and second pairs of antennas 402 and 422 are substantially identical to one another, these antennas need not be identical to one another and each can take on one of the forms shown in FIGS. 3A-3F or any other form of quarter-wave patch antenna, provided all of the quarter-wave patch antennas have a common overlapping bandwidth that satisfies the bandwidth needed for the antenna structure 400.

Translational and rotational deviations in the positions of the quarter-wave patch antennas forming each of the first and second pairs of antennas 402 and 422 can be accommodated and omnidirectional, horizontally polarized signal operation achieved, as discussed with respect to FIGS. 4A-4H. However, the extent of translational and/or rotational deviations that can be tolerated and omnidirectional, horizontally polarized signal processing achieved may be more limited when positional deviations are needed in two or more of the six degrees of freedom. In such cases, an iterative approach may be needed to determine the extent of the positional deviations that can be tolerated in each of degree of freedom for which a deviation is needed and omnidirectional, horizontally polarized signal operation achieved.

Further, translational and rotational deviations in the positions of the first and second pairs of antennas 402, 422 can be accommodated and omnidirectional, horizontally polarized signal operation achieved. In this regard, the deviation in the rotational position of each of the quarter-wave patch antennas associated with both the first and second pairs of antennas 402, 422 must be within a 30° range with respect to each of the other quarter-wave patch antennas in the antenna structure 400 for a selected one of the x-y-z dimensions. With respect to the translational deviations in the positions of quarter-wave patch antennas associated with the first and second pairs of antennas 402, 422, each of the quarter-wave patch antennas associated with the first and second pairs of antennas 402, 422 must satisfy the $\lambda_L/4$ translational deviation limitation with respect to each of the other quarter-wave patch antennas for a selected one of the x-y-z dimensions. However, the extent of translational and/or rotational deviations that can be tolerated and omnidirectional, horizontally polarized signal processing achieved may be more limited when positional deviations are needed in two or more of the six degrees of freedom. In such cases, an iterative approach may be needed to determine the extent of the positional deviations that can be tolerated in each degree of freedom for which a deviation is needed and omnidirectional, horizontally polarized signal operation achieved.

With reference to FIGS. 7C and 7D, the ability of the antenna structure 400 to be used to process a selected one of: (a) an omnidirectional, horizontally polarized beam pattern, (b) a forward end-fire, horizontally polarized beam pattern, (c) an aftward end-fire, horizontally polarized beam pattern, (d) a port side, horizontally polarized beam pattern, and (e) a starboard side, horizontally polarized beam pattern by appropriate control of the signals applied to each of the four feed points in such an antenna structure is described. As shown in FIG. 7C, the feed points 410A, 410B, 430A, 430B of the antenna structure 400 are respectively identified as ports 1, 2, 3, and 4. Further, the antenna 420 is oriented such that an axis 436 of the antenna is oriented so as to be parallel to the roll axis of an aircraft and the first and second pairs of antennas 402, 422 are each close to the same distance from the nose of the aircraft. The axis 436 of the antenna lies in the plane of the monolithic structure 434 that embodies the ground plane(s) for the each of the quarter-wave patch with the perpendicular distance from the axis to a first line defined by the first pair of feed points 410A, 410B being substantially equal to perpendicular distance from the axis to a second line defined by the second pair of feed points 430A, 430B. When the quarter-wave patch antennas forming the antenna structure 400 are not identical to one another and/or there are one or more positional deviations in the positions of the quarter-wave patch antennas forming the antenna structure 400, the axis of the antenna structure is identified by whatever orientation of the antenna yields the omnidirectional, horizontally polarized signal processing with the least ripple. By appropriately controlling the signals applied to the ports 1-4 of the antenna structure 400, any one of five beam patterns can be processed by the antenna. To elaborate, if a 0° phase shift signal is associated with port 1, a 180° phase shift signal is associated with port 2, and ports 3 and 4 are turned "off," the antenna structure 400 is adapted for processing an omnidirectional, horizontally polarized signal. The term "off" associated with one of the ports preferably means that the transmission line associated with port has been switched to a load that matches the characteristic impedance of the transmission line. However, simply switching the transmission line out of the circuit so that a signal does not reach the port may also yield adequate performance. The port, starboard, fore, and aft beam patterns are obtained by applying the combination of phase shifted signals and "off" signals to the ports 1-4 as shown in the table of FIG. 7D. In this regard, it should be noted that there are two combinations of signals that can be applied to the ports to achieve an omnidirectional, horizontally polarized beam pattern, namely, 0-180-180-0 and 0-180-off-off). With respect to each of the directional beam patterns (fore, aft, port, and starboard), the non-zero, phase shifted signals shown in the table can deviate by as much as ±40° relative to the 0° phase-shifted signal and a directional beam pattern achieved. As noted with respect to FIG. 2C, a deviation in the 180° phase shift of ±40° can be tolerated and an omnidirectional, horizontally polarized beam realized.

With reference to FIGS. 8A-8D, an antenna structure with two pairs of back-to-back antennas 500 that is capable of being used to process a selected one of the five horizontally polarized beam patterns is described. The antenna structure 500 includes a first pair of back-to-back antennas 502 and second pair of back-to-back antennas 522. The first pair of back-to-back antennas 502 is substantially identical to the antenna structure 100 (FIG. 4A). Further, the first pair of back-to-back antennas 502 is substantially identical to the second pair of back-to-back antennas 522. The first pair of back-to-back antennas 502 comprises ground planes 504A, 504B, radiator patches 506A, 506B, shorting structures 508A, 508B, and feed points 510A, 510B. Likewise, the second pair of back-to-back antennas 522 comprises ground planes 524A, 524B, radiator patches 526A, 526B, shorting structures 528A, 528B, and feed points 530A, 530B. Characteristic of antenna structure 500 is that: (a) the shorting structures 508A, 508B, 528A, 528B are located between radiator patches 506A, 506B and radiator patches 526A, 526B, (b) the ground planes 504A, 524A are aligned, (c) ground planes 504B, 524B are aligned, and (d) the radiator patches 506A, 526A are aligned, and (e) the radiator patch 526A, 526B are aligned. Further, the distance between radiating edges 512A, 512B of the first pair of back-to-back antennas 502 and radiating edges 532A, 532B of the second pair of back-to-back antennas 522 is about $\lambda_L/2$.

In the illustrated embodiment, the ground planes 504A, 504B, 524A, 524B are embodied on a single, monolithic/integrated structure 534 (e.g., a single metal plate or a printed circuit board with the metallization on one side of the board serving as the ground planes for each of the quarter-wave patch antennas). A separate ground plane for each of the quarter-wave patch antennas is feasible. Also, a separate ground plane structure for each of the first pair of back-to-back antennas 502 and the second pair of back-to-back antennas 522 is feasible. Such separate ground planes can be embodied on the single, monolithic/integrated structure 534, on four separate structures, or on less than four separate structures with one of the structures providing the ground planes for two or more of the quarter-wave patch antennas. The single, monolithic/integrated structure 534 used to realize the ground planes 504A, 504B, 524A, and 524B is shown as extending substantially beyond the area underlying the radiator patches 506A, 506B, 526A, and 526B. In this embodiment, the single, monolithic/integrated structure 534 serves to support the first and second pairs of back-to-back antennas 502, 522 at a desired distance above a surface (e.g., the exterior surface of an aircraft). As such, the monolithic/integrated structure 534 also serves as a stand or as a portion of a stand for the back-to-back antennas 502A, 522A.

While each of the quarter-wave patch antennas associated with the first and second pairs of antennas 502 and 522 are substantially identical to one another, these antennas need not be identical to one another and each can take on one of the forms shown in FIGS. 3A-3F or any other form of quarter-wave patch antenna, provided all of the quarter-wave patch antennas have a common overlapping bandwidth that satisfies the bandwidth needed for the antenna structure 500.

Translational and rotational deviations in the positions of the quarter-wave patch antennas forming each of the first and second pairs of antennas 502 and 522 can be accommodated and omnidirectional, horizontally polarized signal operation achieved, as discussed with respect to FIGS. 4A-4H. However, the extent of translational and/or rotational deviations that can be tolerated and omnidirectional, horizontally polarized signal processing achieved may be more limited when positional deviations are needed in two or more of the six degrees of freedom. In such cases, an iterative approach may be needed to determine the extent of the positional deviations that can be tolerated in each of degree of freedom for which a deviation is needed and omnidirectional, horizontally polarized signal operation achieved.

Further, translational and rotational deviations in the positions of the first and second pairs of antennas 502, 522 can be accommodated and omnidirectional, horizontally polarized signal operation achieved. In this regard, the deviation in the rotational position of each of the quarter-wave patch antennas associated with both the first and second pairs of antennas 502, 522 must be within a 30° range with respect to each of the other quarter-wave patch antennas in the antenna structure 500 for a selected one of the x-y-z dimensions. With respect to the translational deviations in the positions of quarter-wave patch antennas associated with the first and second pairs of antennas 502, 522, each of the quarter-wave patch antennas associated with the first and second pairs of antennas 502, 522 must satisfy the $\lambda_L/4$ translational deviation limitation with respect to each of the other quarter-wave patch antennas for a selected one of the x-y-z dimensions. However, the extent of translational and/or rotational deviations that can be tolerated and omnidirectional, horizontally polarized signal processing achieved may be more limited when positional deviations are needed in two or more of the six degrees of freedom. In such cases, an iterative approach may be needed to determine the extent of the positional deviations that can be tolerated in each degree of freedom for which a deviation is needed and omnidirectional, horizontally polarized signal operation achieved.

With reference to FIGS. 8C and 8D, the ability of the antenna structure 500 to be used to process a selected one of: (a) an omnidirectional, horizontally polarized beam pattern, (b) a combination forward-aftward end-fire, horizontally polarized beam pattern, (c) a port side, horizontally polarized beam pattern, and (d) a starboard side, horizontally polarized beam pattern by appropriate control of the signals applied to each of the four feed points in such an antenna structure is described. As shown in FIG. 8C, the feed points 510A, 510B, 530A, 530B of the antenna structure 500 are respectively identified as ports 1, 2, 3, and 4. Further, the antenna 520 is oriented such that an axis 536 of the antenna is oriented so as to be parallel to the roll axis of an aircraft and the second pair of antennas 522 is closer to the nose of the aircraft than the first pair of antennas 502. The axis 536 of the antenna structure 500 is a line that lies in the plane of the monolithic structure 534 that embodies the ground plane(s) for the each of the quarter-wave patch antennas and intersects the two lines defined by the first pair of feed points 510A, 510B and the second pair of feed points 530A, 530B. When the quarter-wave patch antennas forming the antenna structure 500 are not identical to one another and/or there are one or more positional deviations in the positions of the quarter-wave patch antennas forming the antenna structure 500, the axis of the antenna structure is identified by whatever orientation of the antenna yields the omnidirectional, horizontally polarized signal processing with the least ripple. By appropriately controlling the signals applied to the ports 1-4 of the antenna structure 500, any one of five beam patterns can be processed by the antenna. To elaborate, if a 0° phase shift signal is associated with port 1, a 180° phase shift signal is associated with port 2, and ports 3 and 4 are turned "off," the antenna structure 500 is adapted for processing an omnidirectional, horizontally polarized signal. The term "off" associated with one of the ports preferably means that the transmission line associated with port has been switched to a load that matches the characteristic impedance of the transmission line. However, simply switching the transmission line out of the circuit so that a signal does not reach the port may also yield adequate performance. The port, starboard, fore, and aft beam patterns are obtained by applying the combination of phase shifted signals and "off" signals to the ports 1-4 as shown in FIG. 8D. With respect to each of the directional beam patterns (fore-aft, port, and starboard), the non-zero, phase shifted signals shown in the table can deviate by as much as ±40° relative to the 0° phase-shifted signal and a directional beam pattern achieved. As noted with respect to FIG. 2C, a deviation in the 180° phase shift of ±40° can be tolerated and an omnidirectional, horizontally polarized beam realized.

The control circuitry or beamformer for allowing the antenna structures 200, 300, and 400 to be used to process any of the five beam patterns (i.e., implementing the control structure shown in FIGS. 5D, 6D, and 7D), while readily implemented by those skilled in the art, is highly dependent upon the type of radio communication system that employs the antenna structure In this regard, relevant factors in the design of the control circuitry are whether an active manifold or passive manifold will be employed, whether full duplex or half duplex will be used, and power considerations to name a few. For instance, it should be appreciated that passive manifolds do not include the presence of active devices, such as low-noise amplifiers for receive and/or high-power amplifiers for transmit, while active manifolds include either or both types of amplifiers. Further, passive manifolds require the use of multiple switches to allow for the addition or termination of various ports or beam states along with use of two 0/180-degree hybrids and a single 0/90-degree hybrid. For active manifolds, the bulk of the switches are removed, as there is no need to preserve the efficiency desired in passive networks. In the active case, the communication type is either full duplex, where duplexing filters are used to isolate the transmit and receive amplifiers, or half-duplex, where switched transmit/receive modules are used. In the active case, one approach is to use a 4-state phase shifter, which can provide 0, 90, 180, or 270-degree phase states along with an off or terminated position to allow for the inclusion or exclusion of each antenna port in the final beam state. In any event, the control circuitry will include the combiner/divider and phase-shift circuit 54 shown in FIG. 2B and a 0°/90° phase shift circuit, or functional equivalents. The control/beamformer circuitry for antenna structure 500 has similar considerations. However, while the control circuit will include the combiner/divider and phase shift circuit 54 or a functional equivalent thereof, the control circuit will not need to include a 0°/90° phase shift circuit.

Should a particular application only require that one of the antenna structures 200, 300, 400, and 500 be able to process a subset of the identified beams, the control circuitry can be tailored to implement the control of the ports 1-4 needed for the subset of beams needed to be processed. For example, if the antenna structure 200 is only to be used to process an omnidirectional, port, and starboard horizontally polarized beams, the control circuitry can be tailored accordingly and would not require a 0°/90° phase shift circuit.

With reference to FIGS. 9A-9D and 10A-10C, an embodiment of an antenna structure 600 that includes two pairs of back-to-back, quarter-wave antennas of the type shown in FIGS. 6A-6D and other structures for use in mounting the two pairs of antennas to a mounting surface (e.g., such as the exterior surface of an aircraft) such that the two pairs of antennas are disposed at least $\lambda_L/4$ away from the mounting surface. The antenna structure 600 includes a base 602 for use in mounting the antenna structure to a surface, two pairs of back-to-back, quarter-wave patch antennas 604 (hereinafter two pairs of antennas 604) with an integrated structure 606 that provides the ground planes for the two pairs of antennas 604 and has an extent that allows the two pairs of antennas 604 to be operatively attached to the base 602 at a desired distance from the base, a pair of combiner/divider and phase shift circuits 608A, 608B, and a radome 610 that is operatively attached to the base 602 so as to form an enclosure that protects the two pairs of antennas 604 and the circuits 608A, 608B from the external environment.

The two pairs of antennas 604 includes a first pair of back-to-back, quarter-wave antennas 612A, a second pair of back-to-back, quarter-wave antennas 612B, and an isolator 614. The single, integrated structure 606 preferably is a circuit board with a metallized area 618 on one side of the board extending over an area sufficient to provide the ground planes required for each of quarter-wave patch antennas embodied in the two pairs of antenna 604. The other side of the board is metallized so as to realize the combiner/divider and 180° phase shift circuits 608A, 608B that, in combination with a 90° phase shifter (not shown), allow the two pairs of antennas 604 to be operated so as to process a horizontally polarized signal with a selected one of an omnidirectional beam pattern, a forward end-fire beam pattern, and an aftward end-fire beam pattern (i.e., a subset of the possible patterns set forth in FIG. 6D). It should be appreciated that the combiner/divider and phase shift circuits 608A, 608B need not be located the board and can be located a substantial distance away from the two pairs of antennas 604. Notably, the metallization used to realize the ground planes for the two pairs of antennas 604 and the combiner/divider and phase shift circuits 608A, 608B allow for the incorporation of other antennas/circuits on the board. In this regard, a pair of monopole antennas 620A, 620B to be established on the board that are each capable of processing vertically polarized signals. The structure 606 has a sufficient extent that the two pair of antennas 604 are disposed at least $\lambda_L/4$ away from whatever mounting surface is engaged by the base 602. There are numerous ways known to those skilled in the art to attach structure 606 to the base 602. In one preferred approach, L-brackets are used to attach the structure 606 to the base 602.

The radome 610, due to the ability to design the two pairs of antennas 604 so as to have a much smaller horizontal profile (i.e., the distance between the radiator patches) than the horizontal profile associate with antennas of the type disclosed in U.S. Pat. No. 6,249,260, can have a thin, aerodynamic shape that is commonly referred to as a "blade" shape. The radome 610 includes a top surface 624, a side surface 626 with a front surface 628 and trailing surface 630, and a brim 632. The brim 632 is attached to an outer edge of the base 602. While there are numerous approaches to attaching the brim 632 to the base 602 known to those skilled in the art, one preferred approach employs bolts that each extend through a hole that extends through the brim 632 and the base 602 (not shown) and is engaged by a nut or comparable device. The base 602 is also attached to a surface (e.g., the exterior of an aircraft) by bolts that each extend through a hole that extends through the radome 632, the base 602, and the surface and is engaged by a nut or comparable device. Other approaches to attaching the base 602 to the surface known to those skilled in the art can be employed if needed or desired.

It should be appreciated that, while the antenna structure 600 includes two pairs of back-to-back, quarter-wave antennas that have the same basic structure as antenna structure 300, comparable antenna structures that employ two pairs of back-to-back antenna structures, like antenna structures 200, 400, and 500, can be realized. Further, comparable antennas structures that use a single pair of back-to-back antenna structures, such as antenna structure 100, can be realized. Notably, antenna structures with bases and radomes that employ antenna structures like antenna structures 100 and 400 can employ a radome with a reduce depth profile relative to those antenna structures that have antenna structures like antenna structure 200, 400, and 500 (i.e., the radome does not need to be as long between the front and trailing surfaces).

Figure 11:
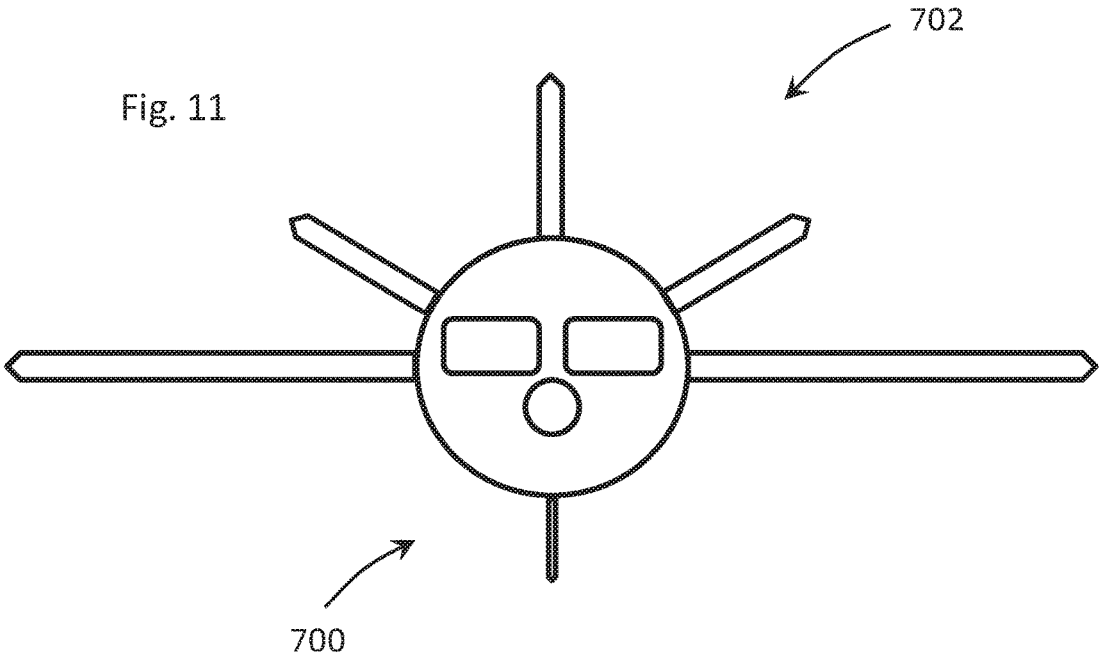
FIG. 11 is a schematic diagram of the antenna structure shown in FIGS. 9A-9D and 10A-10C mounted on the underside of an aircraft.

With reference to FIG. 11, an antenna structure 700 that employs one or two pairs of back-to-back, quarter-wave antennas, a base, and a radome (preferably with a blade profile) is shown in association with an aircraft 702. The antenna structure 700 is situated on the aircraft so that when the aircraft is in level flight and the axis of the antenna structure 700 is parallel to the roll axis of the aircraft 702, the antenna structure 700 is capable of being used to process horizontally polarized signals with at least an omnidirectional beam pattern. In the case in which the antenna structure 700 employs two pairs of back-to-back, quarter-wave antennas, the antenna structure 700 may be capable of processing horizontally polarized signals with forward, aftward, combination forward-aftward, port, and starboard beam patterns. While the antenna structure 700 is shown as being attached to the bottom surface of the fuselage of the aircraft 702, the antenna structure 700 can be adapted to be attached to other locations associated with an aircraft.

The foregoing description of the invention is intended to explain the best mode known of practicing the invention and to enable others skilled in the art to utilize the invention in various embodiments and with the various modifications required by their particular applications or uses of the invention.

What is claimed is:

1. An antenna structure comprising:

a first quarter-wave patch antenna comprising a first ground plane, a first radiator patch, a first shorting structure connecting the first ground plane and the first patch, and a first feed point for providing a first signal to the first radiator patch;

a second quarter wave patch antenna comprising a second ground plane, a second radiator patch, a second shorting structure connecting the second ground plane and the second patch, and a second feed point for providing a second signal to the first radiator patch;

wherein the first ground plane and the second ground plane are positioned between the first radiator patch and the second radiator patch;

wherein, if the first and second shorting structures are considered to be a single structure, the first and second radiators each extend away from the single structure in substantially the same direction; and a combiner/divider for engaging: (a) a first conductor associated with the first feed point and, in operation, carrying the first signal, (b) a second conductor associated with the second feed point and, in operation, carrying the second signal with a phase-shift of substantially 180° relative to the first signal, and (c) a sum conductor adapted to engage a transmitter/receiver and carrying, in operation, a sum signal that is the sum of the first signal and second signal.

2. An antenna structure, as claimed in claim 1, wherein;

the first ground plane and the second ground plane are substantially parallel to one another.

3. An antenna structure, as claimed in claim 1, wherein:

the first ground plane and the second ground plane are part of one of: (a) a single, monolithic structure and (b) a single, integrated structure.

4. An antenna structure, as claimed in claim 1, wherein:

the first radiator patch and the second radiator patch are substantially parallel to one another.

5. An antenna structure, as claimed in claim 1, wherein:

the first radiator patch is separated from the first ground plane by no more than about $\lambda_L/4$, where $\lambda_L$ is the wavelength associated with the frequency that defines the low-end of the bandwidth for the radiator structure; and the second radiator patch is separated from the second ground plane by no more than about $\lambda L/4$.

6. An antenna structure, as claimed in claim 1, wherein:

the first quarter-wave patch antenna and the second quarter-wave patch antennas are mirror images of one another relative to a mirror plane located between the first radiator patch and the second radiator patch.

7. An antenna structure, as claimed in claim 1, further comprising:

the first ground plane and the second ground plane are separated by no more than about $\lambda_L/4$, where $\lambda_L$ is the wavelength associated with the frequency that defines the low-end of the bandwidth for the radiator structure.

8. An antenna structure, as claimed in claim 1, further comprising:

a stand that extends from a first terminal end to a second terminal end, the first terminal end being adapted to engage a structure and the second terminal end adapted to support the first and second quarter-wave patch antennas at a distance of at least $\lambda_L/4$ from the first terminal end of the stand, where $\lambda_L$ is the wavelength associated with the frequency that defines the low-end of the bandwidth for the radiator structure.

9. An antenna structure, as claimed in claim 1, further comprising:

a third quarter-wave patch antenna comprising a third ground plane, a third radiator patch, a third shorting structure connecting the third ground plane and the third patch, and a third feed point for providing a third signal to the third radiator patch; and a fourth quarter wave patch antenna comprising a fourth ground plane, a fourth radiator patch, a fourth shorting structure connecting the fourth ground plane and the fourth patch, and a fourth feed point for providing a fourth signal to the first radiator patch;

wherein the third ground plane and the fourth ground plane are positioned between the third radiator patch and the fourth radiator patch;

wherein, if the third and fourth shorting structures are considered to be a single structure, the third and fourth radiators each extend away from the single structure in substantially the same direction;

wherein the third ground plane and the fourth ground plane are separated by no more than about $\lambda L/4$, where $\lambda_L$ is the wavelength associated with the frequency that defines the low-end of the bandwidth for the radiator structure.

10. An antenna structure, as claimed in claim 1, further comprising:

a radome that defines a volume for housing the first and second quarter-wave patch antennas, the radome having a blade or tear drop shape.

11. An antenna structure comprising:

a first quarter-wave patch antenna comprising a first ground plane, a first radiator patch, a first shorting structure connecting the first ground plane and the first patch, and a first feed point for providing a first signal to the first radiator patch;

a second quarter wave patch antenna comprising a second ground plane, a second radiator patch, a second shorting structure connecting the second ground plane and the second patch, and a second feed point for providing a second signal to the first radiator patch;

wherein the first ground plane and the second ground plane are positioned between the first radiator patch and the second radiator patch;

wherein, if the first and second shorting structures are considered to be a single structure, the first and second radiators each extend away from the single structure in substantially the same direction; and a stand that extends from a first terminal end to a second terminal end, the first terminal end being adapted to engage a structure and the second terminal end adapted to support the first and second quarter-wave patch antennas at a distance of at least $\lambda_L/4$ from the first terminal end of the stand, where $\lambda_L$ is the wavelength associated with the frequency that defines the low-end of the bandwidth for the radiator structure.

12. An antenna structure, as claimed in claim 11, further comprising:

an aircraft operatively engaged to the first terminal end of the stand.

13. An antenna structure, as claimed in claim 11, further comprising:

the first ground plane and the second ground plane are separated by no more than about $\lambda_L/4$, where $\lambda_L$ is the wavelength associated with the frequency that defines the low-end of the bandwidth for the radiator structure.

14. An antenna structure, as claimed in claim 11, further comprising:

a combiner/divider for engaging: (a) a first conductor associated with the first antenna feed point and, in operation, carrying the first signal, (b) a second conductor associated with the second antenna feed point and, in operation, carrying the second signal with a phase-shift of substantially 180° relative to the first signal, and (c) a sum conductor adapted to engage a transmitter/receiver and carrying, in operation, a sum signal that is the sum of the first signal and second signal.

15. An antenna structure, as claimed in claim 11, wherein:

the first radiator patch is separated from the first ground plane by no more than about $\lambda_L/4$, where $\lambda_L$ is the wavelength associated with the frequency that defines the low-end of the bandwidth for the radiator structure; and the second radiator patch is separated from the second ground plane by no more than about $\lambda L/4$.

16. An antenna structure, as claimed in claim 11, further comprising:

a third quarter-wave patch antenna comprising a third ground plane, a third radiator patch, a third shorting structure connecting the third ground plane and the third patch, and a third feed point for providing a third signal to the third radiator patch; and a fourth quarter wave patch antenna comprising a fourth ground plane, a fourth radiator patch, a fourth shorting structure connecting the fourth ground plane and the fourth patch, and a fourth feed point for providing a fourth signal to the first radiator patch;

wherein the third ground plane and the fourth ground plane are positioned between the third radiator patch and the fourth radiator patch; and wherein, if the third and fourth shorting structures are considered to be a single structure, the third and fourth radiators each extend away from the single structure in substantially the same direction;

wherein the third ground plane and the fourth ground plane are separated by no more than about $\lambda L/4$, where $\lambda_L$ is the wavelength associated with the frequency that defines the low-end of the bandwidth for the radiator structure.

17. An antenna structure, as claimed in claim 11, further comprising:

a radome that defines a volume for housing the first and second quarter-wave patch antennas, the radome having a blade or tear drop shape.

18. An antenna structure, as claimed in claim 17, wherein:

the radome forms at least a portion of the stand.

19. An antenna structure, as claimed in claim 11, further comprising: an aircraft operatively engaged to the first terminal end of the stand.

20. An antenna structure comprising:

a first quarter-wave patch antenna comprising a first ground plane, a first radiator patch, a first shorting structure connecting the first ground plane and the first patch, and a first feed point for providing a first signal to the first radiator patch;

a second quarter wave patch antenna comprising a second ground plane, a second radiator patch, a second shorting structure connecting the second ground plane and the second patch, and a second feed point for providing a second signal to the first radiator patch;

wherein the first ground plane and the second ground plane are positioned between the first radiator patch and the second radiator patch;

wherein, if the first and second shorting structures are considered to be a single structure, the first and second radiators each extend away from the single structure in substantially the same direction;

wherein the first ground plane and the second ground plane are separated by no more than about $\lambda L/4$, where $\lambda_L$ is the wavelength associated with the frequency that defines the low-end of the bandwidth for the radiator structure;

a third quarter-wave patch antenna comprising a third ground plane, a third radiator patch, a third shorting structure connecting the third ground plane and the third patch, and a third feed point for providing a third signal to the third radiator patch; and a fourth quarter wave patch antenna comprising a fourth ground plane, a fourth radiator patch, a fourth shorting structure connecting the fourth ground plane and the fourth patch, and a fourth feed point for providing a fourth signal to the first radiator patch;

wherein the third ground plane and the fourth ground plane are positioned between the third radiator patch and the fourth radiator patch;

wherein, if the third and fourth shorting structures are considered to be a single structure, the third and fourth radiators each extend away from the single structure in substantially the same direction;

wherein the first ground plane and the second ground plane are separated by no more than about $\lambda L/4$, where $\lambda_L$ is the wavelength associated with the frequency that defines the low-end of the bandwidth for the radiator structure.

21. An antenna structure, as claimed in claim 20, wherein:

the combination of the first and second quarter-wave antennas constitutes a first antenna pair; and the combination of the third and fourth quarter-wave antennas constitutes a second antenna pair.

22. An antenna structure, as claimed in claim 21, wherein:

the first antenna pair is oriented relative to the second antenna pair such that: (a) the first and second shorting structures are located between the first and second radiator patches and the third and fourth radiator structures, (b) the third and fourth radiator patches are located between the first and second shorting structures and the third and fourth shorting structures, (c) the first ground plane and third ground plane are substantially coplanar, (d) the second ground plane and the fourth ground plane are substantially coplanar, (e) the first radiator patch and the third radiator patch are substantially coplanar, and (f) the second radiator patch and the fourth radiator patch are substantially aligned.

23. An antenna structure, as claimed in claim 21, wherein:

the first antenna pair is oriented relative to the second antenna pair such that: (a) the first, second, third, and fourth radiator patches are positioned between the first and second shorting structures and the third and fourth shorting structures, (b) the first ground plane and third ground plane are substantially coplanar, (c) the second ground plane and the fourth ground plane are substantially coplanar, (d) the first radiator patch and the third radiator patch are substantially coplanar, and (e) the second radiator patch and the fourth radiator patch are substantially aligned.

24. An antenna structure, as claimed in claim 23, further comprising:

an isolator structure with an "I" shape having a vertical member, a first cross-member connected to the vertical member, and a second cross-member connected to the vertical member;

wherein the isolator structure is located between the first antenna pair and the second antenna pair.

25. An antenna structure, as claimed in claim 21, wherein:

The first antenna pair is oriented relative the second antenna pair such that: (a) first and second shorting structures are substantially coplanar with one another, (b) the third and fourth radiators respectively have third and fourth ends that define a second plane, (c) the first and second shorting structures are substantially coplanar with the second plane, (d) the third and fourth shorting structures are substantially coplanar with one another, (e) the first and second radiators respectively have first and second ends that define a first plane, and (f) the third and fourth radiator structures are substantially coplanar with the first plane.

26. An antenna structure, as claimed in claim 21, wherein:

the first antenna pair is oriented relative to the second antenna pair such that: (a) the first, second, third, and fourth shorting structures are located between the first and second radiator patches and the third and fourth radiator patches, (b) the first ground plane and third ground plane are substantially coplanar, (c) the second ground plane and the fourth ground plane are substantially coplanar, (d) the first radiator patch and the third radiator patch are substantially coplanar, and (e) the second radiator patch and the fourth radiator patch are substantially aligned.

27. An antenna structure, as claimed in claim 21, further comprising:

a multi-input and multi-output (MIMO) manifold operatively connected to at least two of the first, second, third, and fourth feed points.

28. An antenna structure, as claimed in claim 21, further comprising:

a switching network for controlling: (a) whether each of the first, second, third, and fourth feed points is enabled and capable of conveying a signal or disabled and incapable of conveying a signal and (b) for each of the first, second, third, and fourth feed points that is enabled and capable of carrying a signal, which one of one of four possible phase shifts will be applied to whatever signal is carried by the enabled feed point.

29. An antenna structure, as claimed in claim 28, wherein:

the four possible phase shifts are 0°, 90°, 180°, and 270°.

30. An antenna structure, as claimed in claim 21, further comprising:

a switching network for controlling: (a) whether each of the first, second, third, and fourth feed points is enabled and capable of conveying a signal or disabled and incapable of conveying a signal and (b) for each of the first, second, third, and fourth feed points that is enabled and capable of carrying a signal, a phase shift that in combination with the phase shifts applied to the other enabled feed points yields a desired beam pattern.

31. An antenna structure, as claimed in claim 20, further comprising:

a radome that defines a volume for housing the first, second, third, and fourth quarter-wave patch antennas, the radome having a blade or tear drop shape.

32. An antenna structure, as claimed in claim 20, further comprising:

a stand that extends from a first terminal end to a second terminal end, the first terminal end being adapted to engage a structure and the second terminal end adapted to support the first, second, third, and fourth quarter-wave patch antennas at a distance of at least $\lambda L/4$ from the first terminal end of the stand.

33. An antenna structure, as claimed in claim 32, further comprising: an aircraft operatively engaged to the first terminal end of the stand.

34. An antenna structure, as claimed in claim 20, further comprising:

a switching network for controlling: (a) whether each of the first, second, third, and fourth feed points is enabled and capable of conveying a signal or disabled and incapable of conveying a signal and (b) for each of the first, second, third, and fourth feed points that is enabled and capable of carrying a signal, which one of four possible phase shifts will be applied to whatever signal is carried by the enabled feed point.

* * * * *